US011225748B2

(12) United States Patent
Kim et al.

(10) Patent No.: US 11,225,748 B2
(45) Date of Patent: Jan. 18, 2022

(54) LAUNDRY MACHINE

(71) Applicant: Samsung Electronics Co., Ltd., Suwon-si (KR)

(72) Inventors: Sang Wook Kim, Suwon-si (KR); Young Jin Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 108 days.

(21) Appl. No.: 15/753,437

(22) PCT Filed: Aug. 11, 2016

(86) PCT No.: PCT/KR2016/008843

§ 371 (c)(1),
(2) Date: Feb. 19, 2018

(87) PCT Pub. No.: WO2017/034191

PCT Pub. Date: Mar. 2, 2017

(65) Prior Publication Data

US 2018/0327957 A1 Nov. 15, 2018

(30) Foreign Application Priority Data

Aug. 25, 2015 (KR) ..... 10-2015-0119275

(51) Int. Cl.
*D06F 37/26* (2006.01)
*D06F 37/14* (2006.01)

(52) U.S. Cl.
CPC ..... *D06F 37/263* (2013.01); *D06F 37/14* (2013.01); *D06F 37/26* (2013.01); *D06F 37/264* (2013.01)

(58) Field of Classification Search
CPC ..... D06F 23/04; D06F 37/12; D06F 37/14; D06F 37/145; D06F 37/16; D06F 37/263;
(Continued)

(56) References Cited

U.S. PATENT DOCUMENTS 9,428,853 B2 8/2016 Kim et al.
2005/0005652 A1* 1/2005 Park ..... D06F 37/263 68/24

(Continued)

FOREIGN PATENT DOCUMENTS

CN 201121270 Y 9/2008
CN 201169691 Y 12/2008

(Continued)

OTHER PUBLICATIONS

CN201121270Y Machine Translation (Year: 2008).*

(Continued)

*Primary Examiner* — Spencer E. Bell

(57) ABSTRACT

A washing machine includes a body and a rotating tub rotatably installed in the inside of the body and provided with a cylindrical portion formed in the cylindrical shape and a bowl portion coupled to a lower portion of the cylindrical portion, the bowl portion includes a main member formed of a resin material and a cover member coupled to an upper surface of the main member and formed of a metal material, the cover member includes a first engaging portion to be coupled to the main member, and the main member includes a second engaging portion coupled to the first engaging portion. Therefore, the bowl portion of the washing machine rotating tub can be manufactured at low cost while having durability, corrosion resistance, strength, hygienic properties, and clean feeling.

12 Claims, 31 Drawing Sheets

(58) Field of Classification Search
CPC . D06F 37/26–264; D06F 37/20; D06F 37/269
See application file for complete search history.

(56) References Cited

U.S. PATENT DOCUMENTS

| | | | | |
|---|---|---|---|---|
| 2010/0287995 | A1* | 11/2010 | Mancini | D06F 37/262 68/139 |
| 2011/0148260 | A1* | 6/2011 | Silva | D06F 23/04 312/228 |
| 2013/0160217 | A1* | 6/2013 | Tietz | D06F 39/10 8/137 |
| 2014/0033772 | A1* | 2/2014 | Jung | D06F 37/26 68/131 |
| 2017/0218547 | A1* | 8/2017 | Lv | D06F 37/264 |
| 2018/0016732 | A1* | 1/2018 | Tanaka | D06F 23/04 |

FOREIGN PATENT DOCUMENTS

| | | | |
|---|---|---|---|
| CN | 102031668 | A | 4/2011 |
| CN | 102978867 | A | 3/2013 |
| CN | 103335026 | A | 10/2013 |
| JP | H11300082 | A | 11/1999 |
| JP | 2005-028145 | A | 2/2005 |
| JP | 2005-137911 | A | 6/2005 |
| JP | 2011072350 | A | 4/2011 |
| KR | 10-1999-0079733 | A | 11/1999 |
| KR | 20-2000-0000013 | Y1 | 6/2000 |
| KR | 20-2000-0009823 | U | 6/2000 |
| KR | 10-2005-0006333 | A | 1/2005 |
| KR | 10-2014-0018681 | A | 2/2014 |

OTHER PUBLICATIONS

ISA/KR, "International Search Report and Written Opinion," Application No. PCT/KR2016/008843, dated Nov. 15, 2016, 12 pages.
Office Action dated Jul. 29, 2019 in connection with Chinese Patent Application No. 201680049148.1, 19 pages.
Office Action dated Mar. 17, 2020 in connection with India Patent Application No. 201817001969, 6 pages.
Office Action dated Oct. 10, 2020 in connection with Chinese Patent Application No. 201680049148.1, 22 pages.
Hearing Notice dated Sep. 1, 2021, in connection with Indian Application No. 201817001969, 2 pages.
Notice Requesting Submission of Opinion dated Oct. 14, 2021, in connection with Korean Application No. 10-2015-0119275, 21 pages.

* cited by examiner

【Fig. 1】
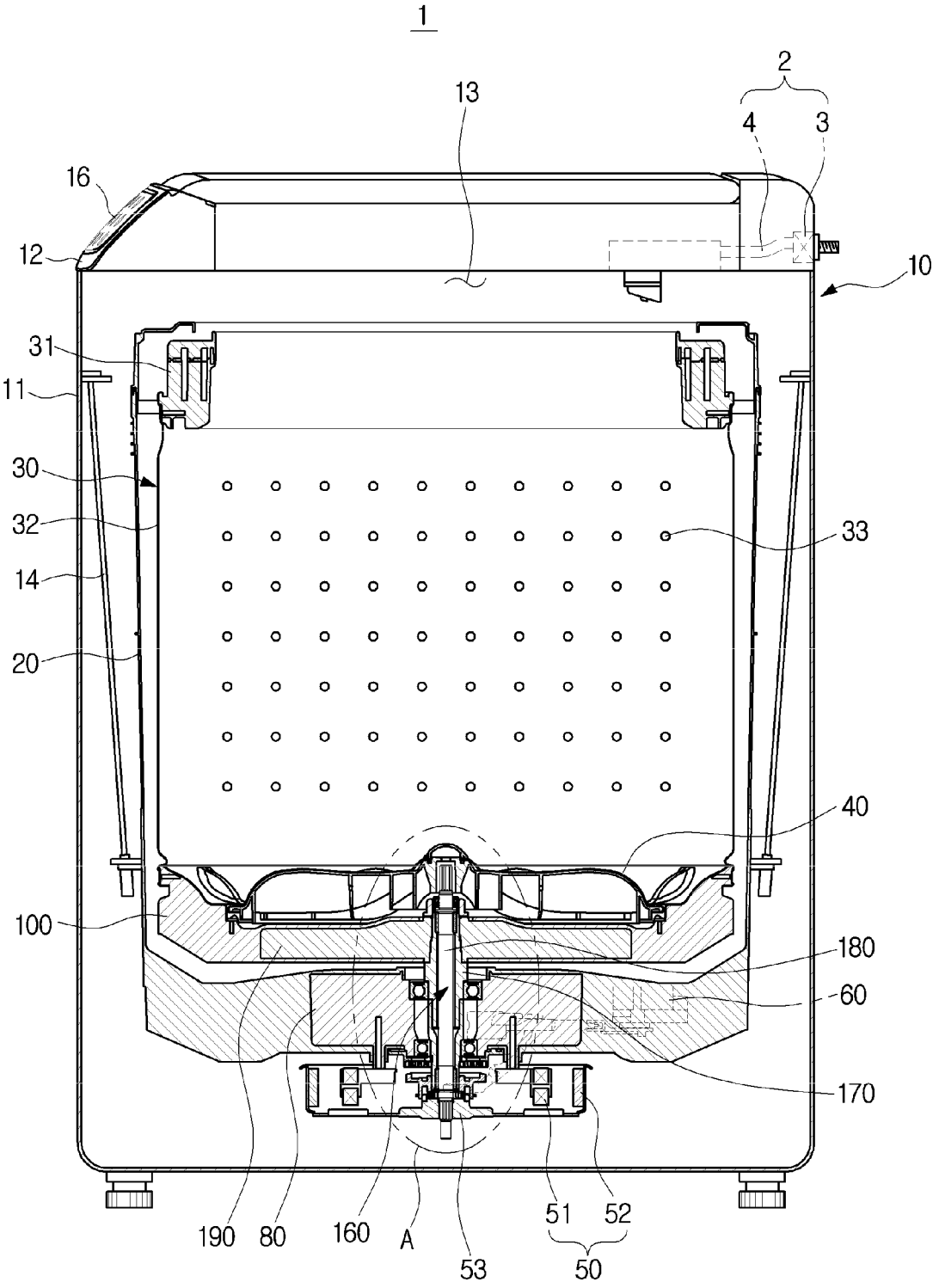

【Fig. 2】
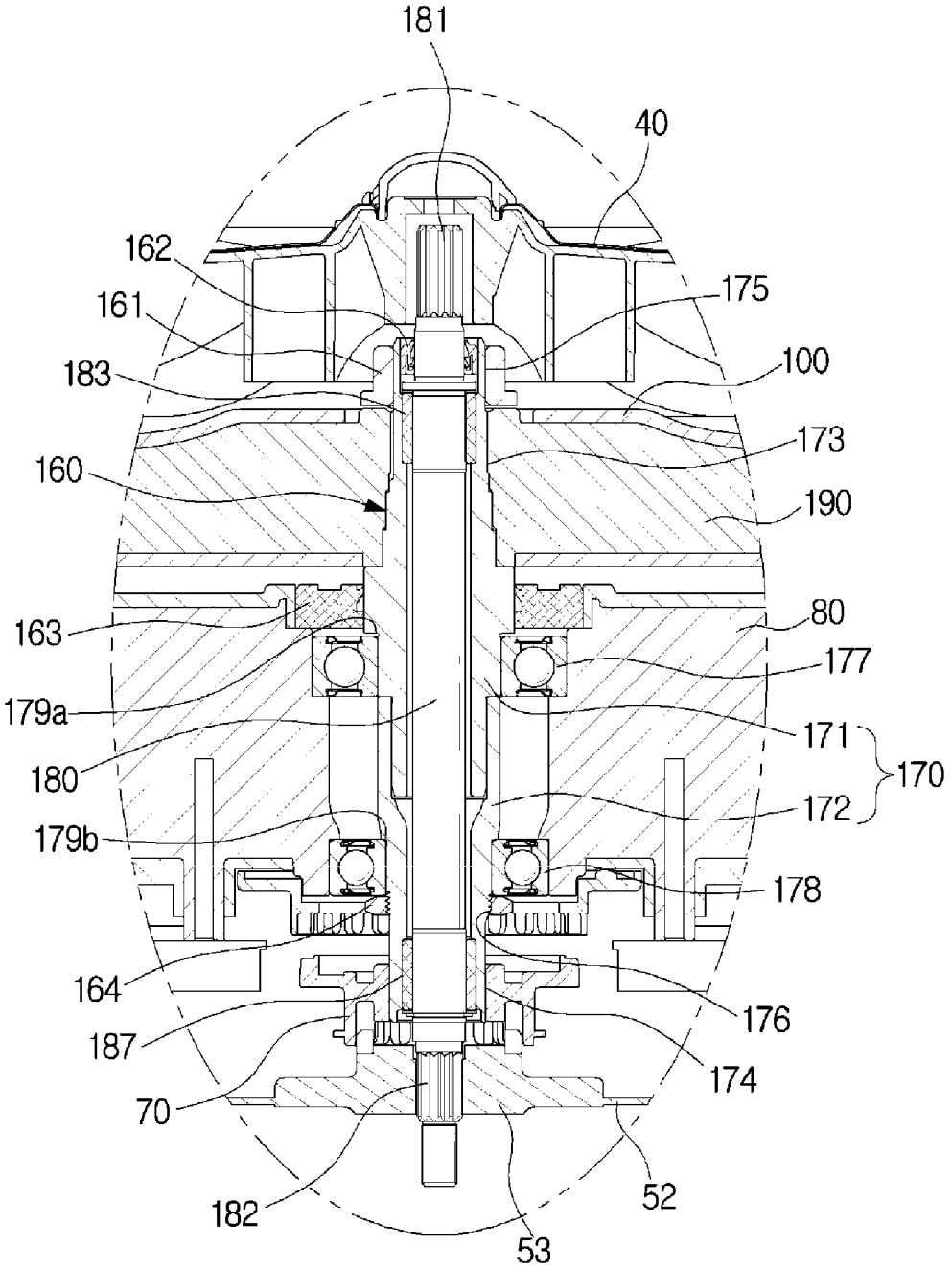

【Fig. 3】
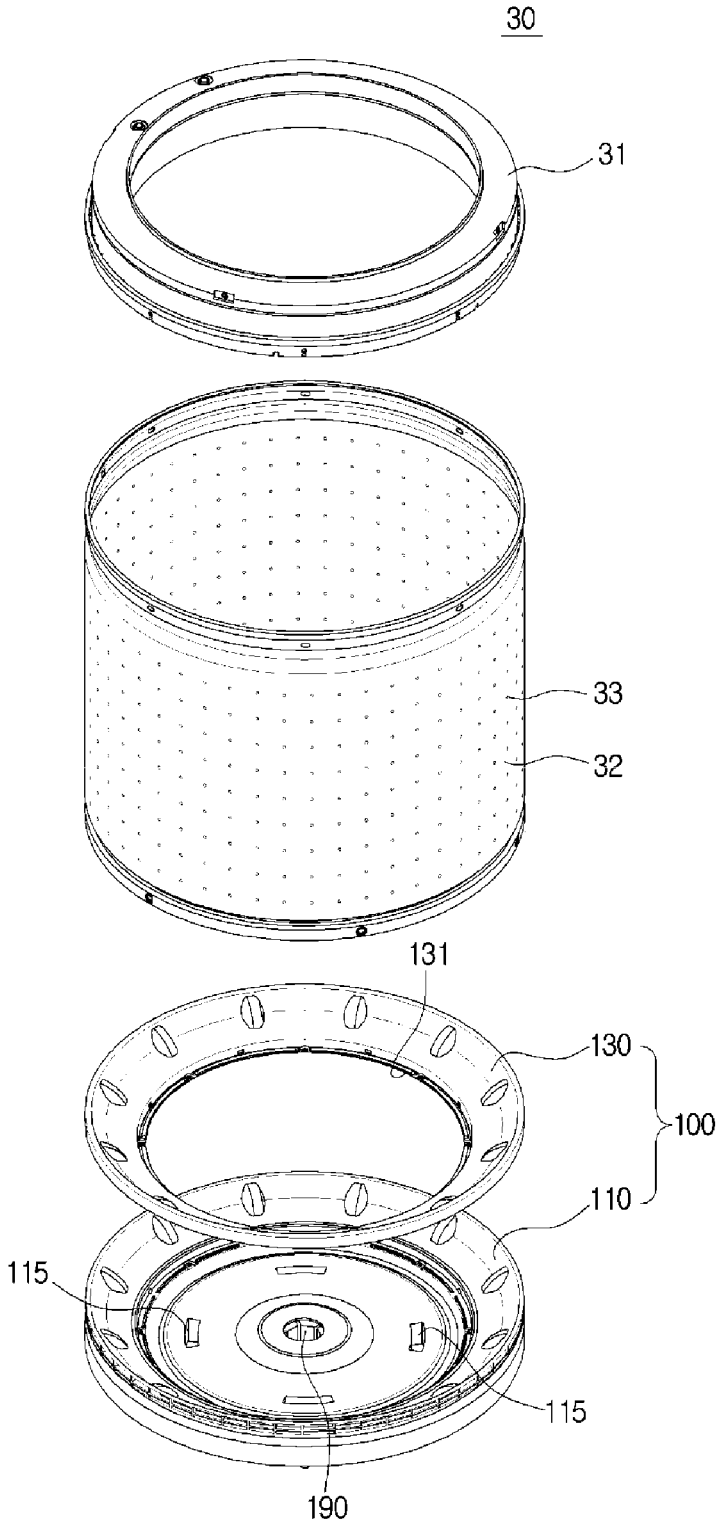

【Fig. 4】
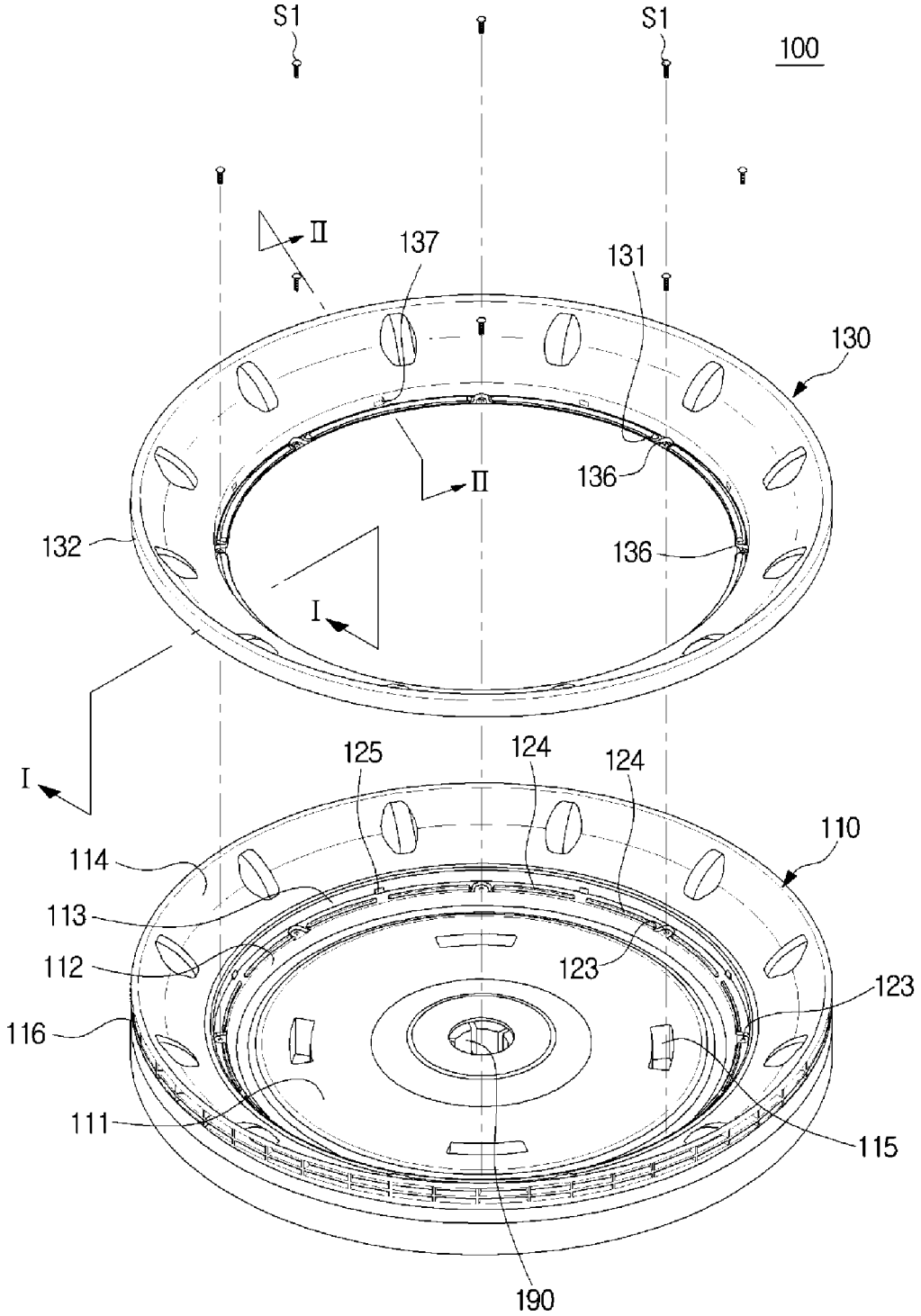

【Fig. 5】
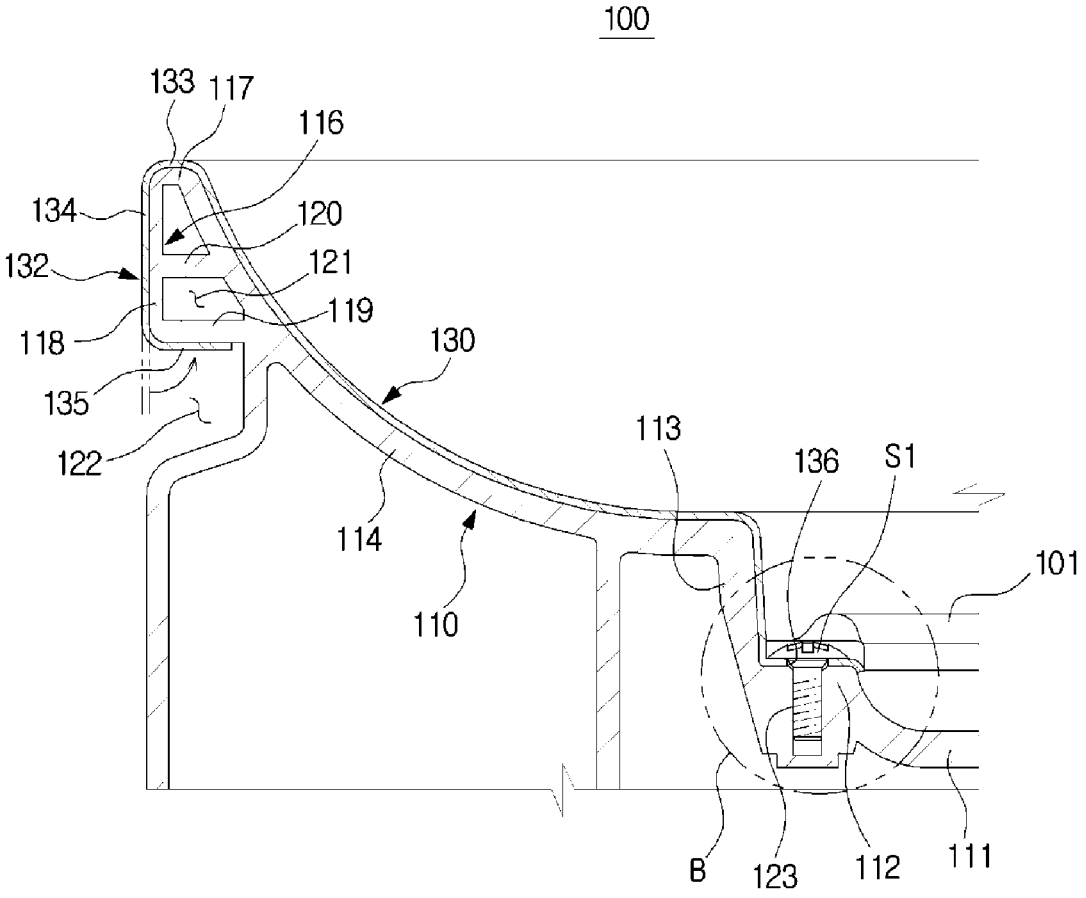

【Fig. 6】
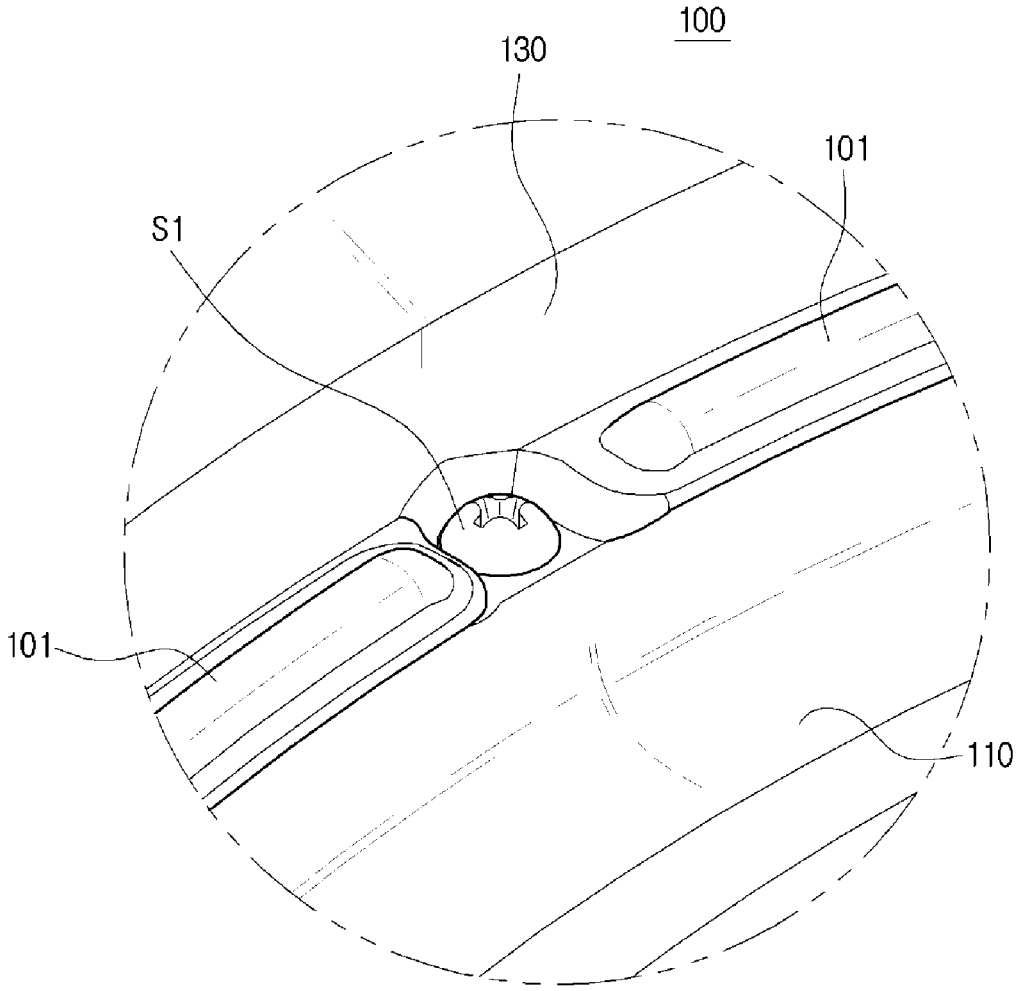

【Fig. 7】
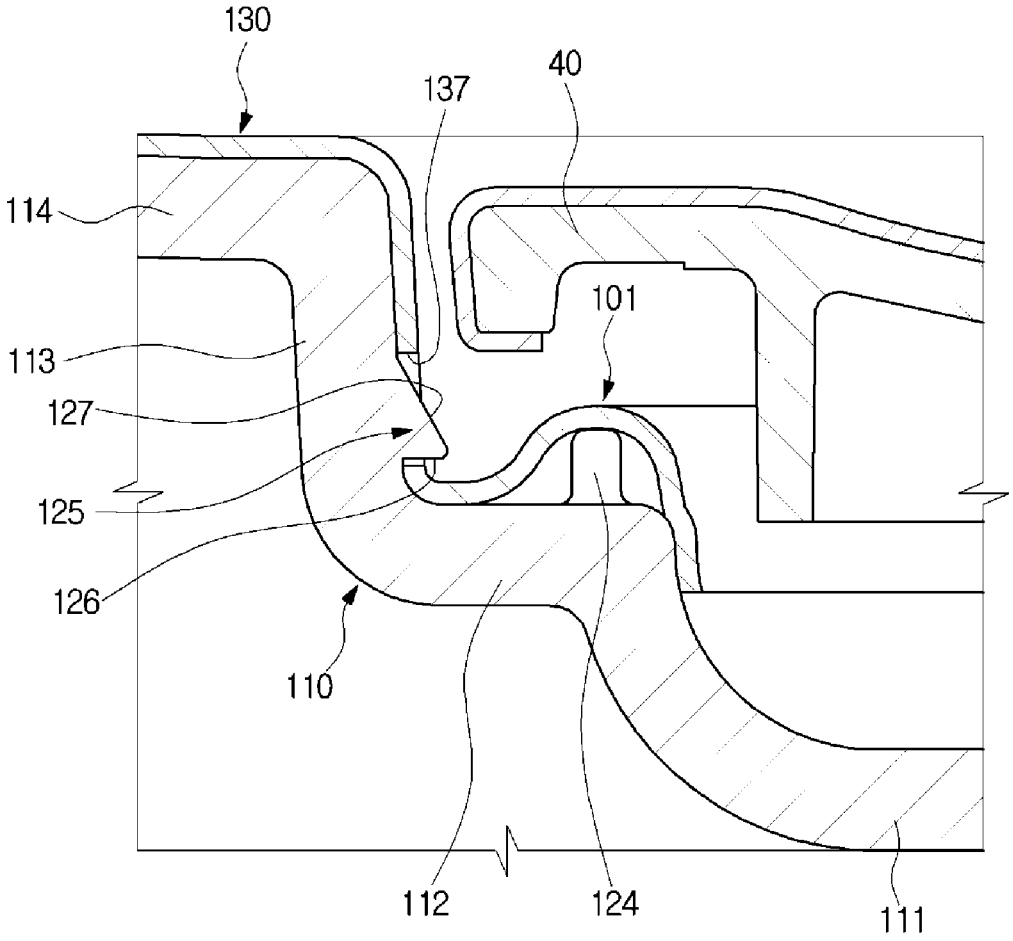

【Fig. 8】
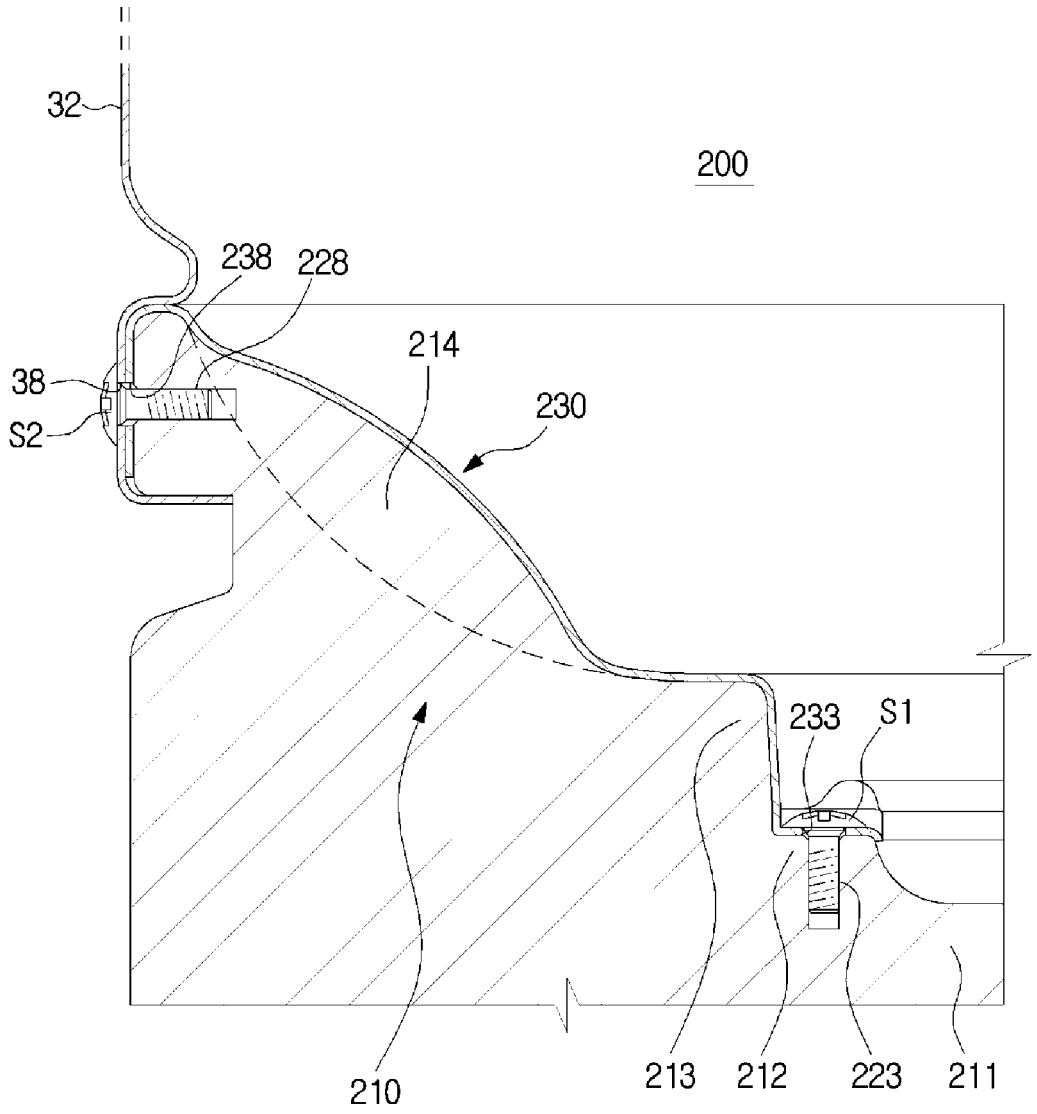

【Fig. 9】
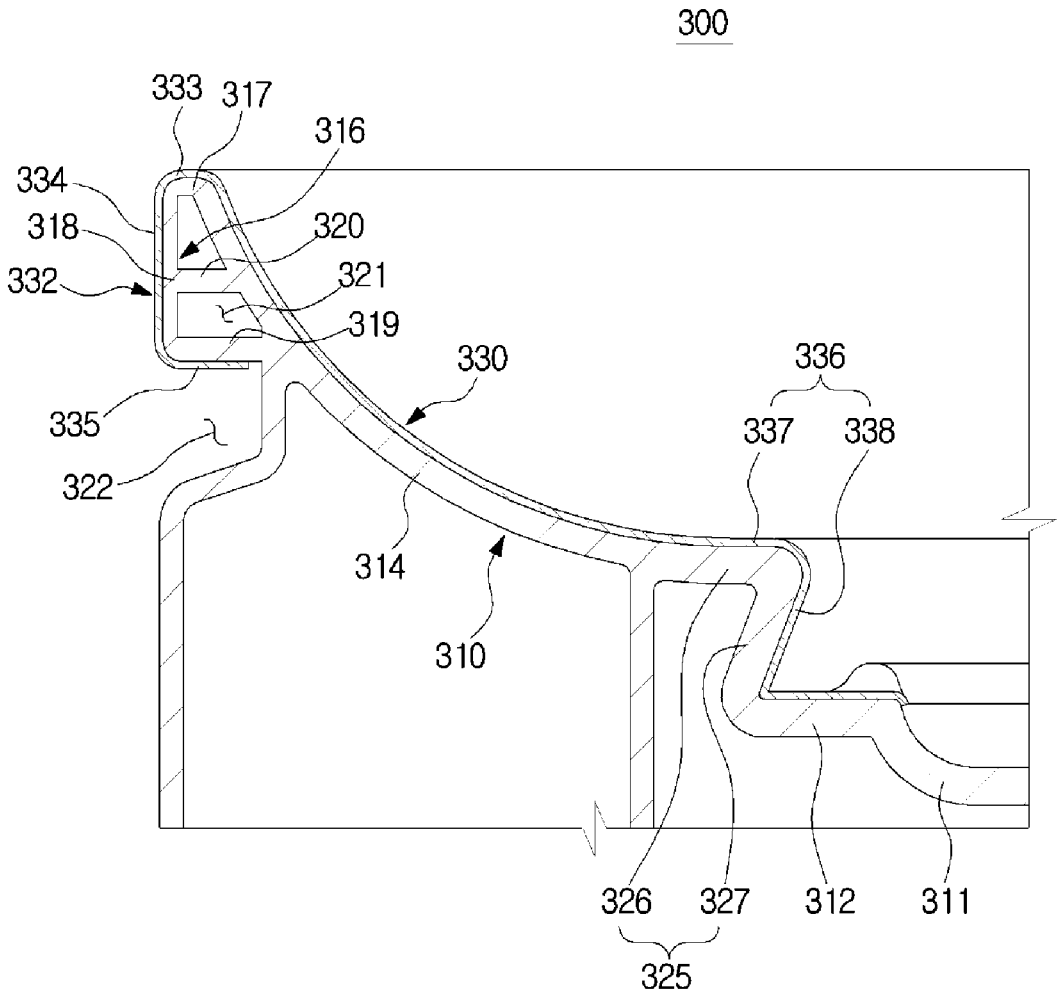

【Fig. 10】
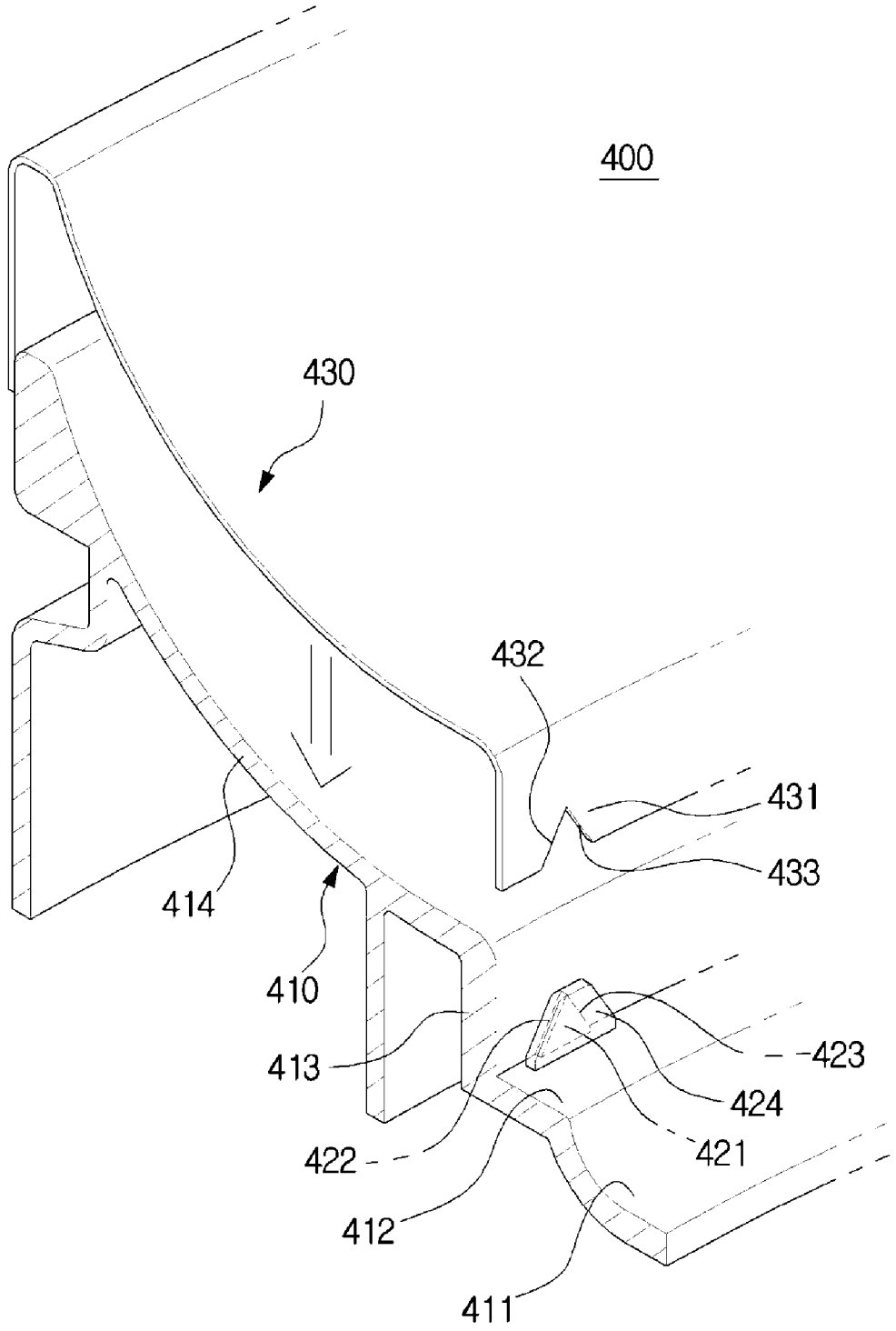

【Fig. 11】
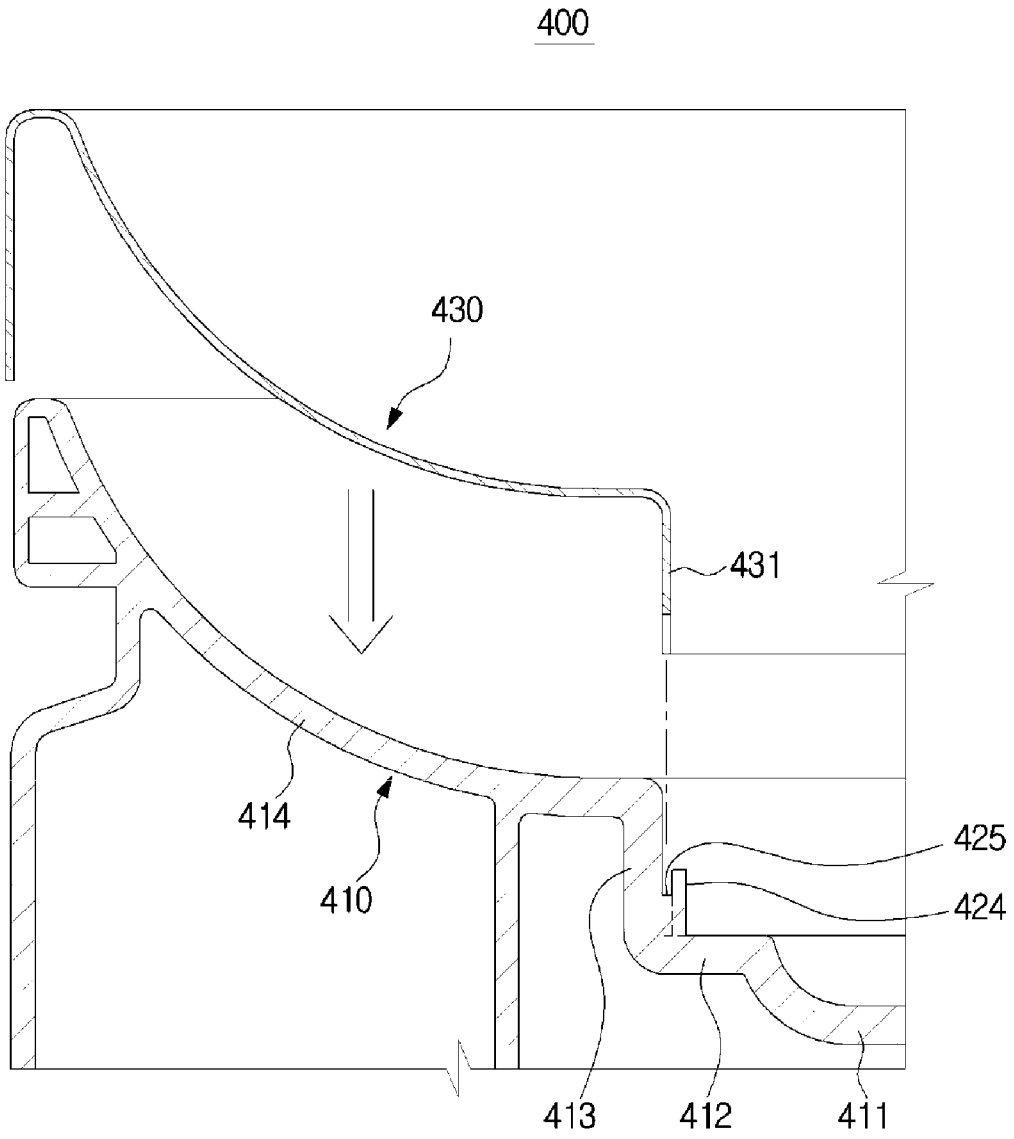

【Fig. 12】
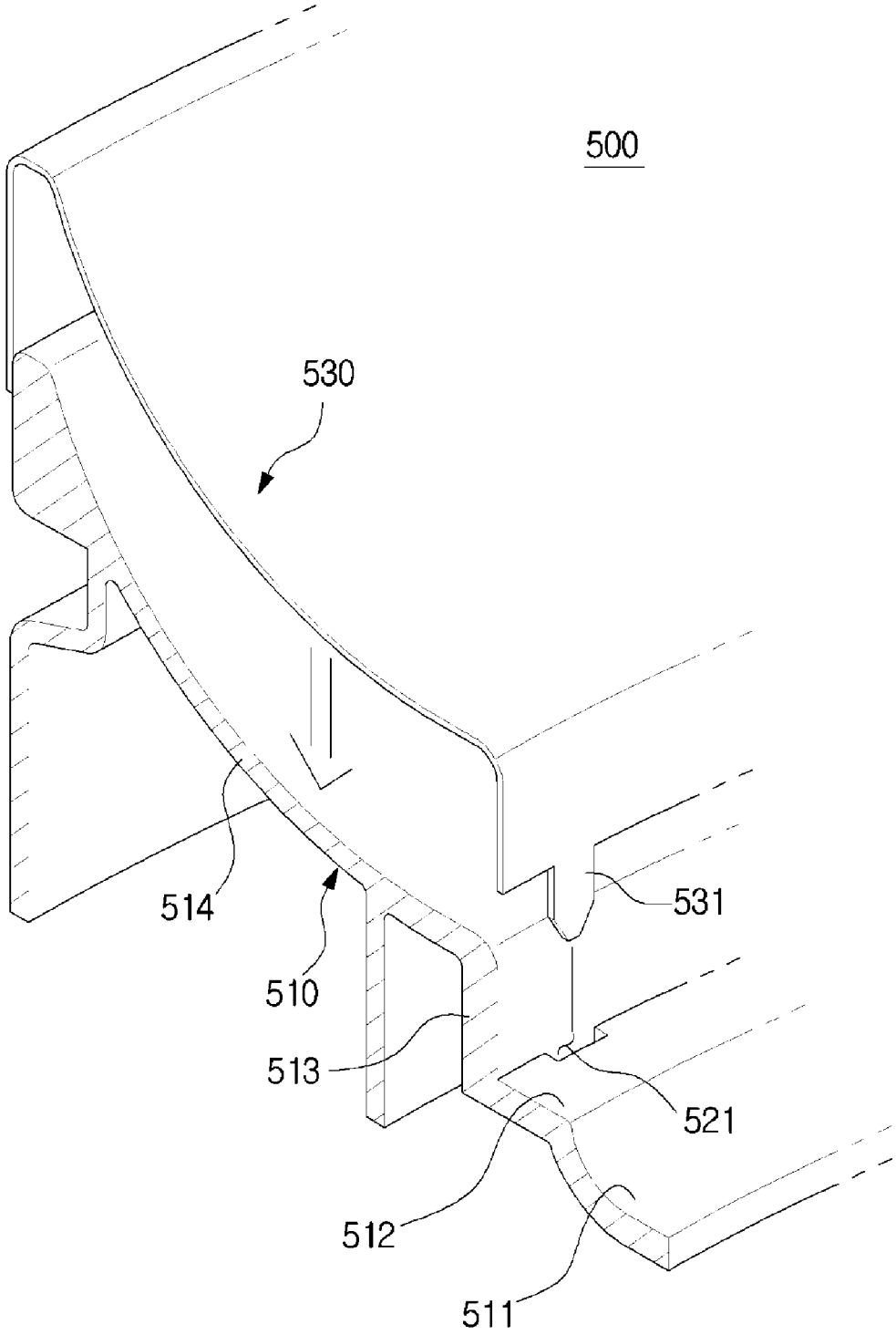

【Fig. 13】
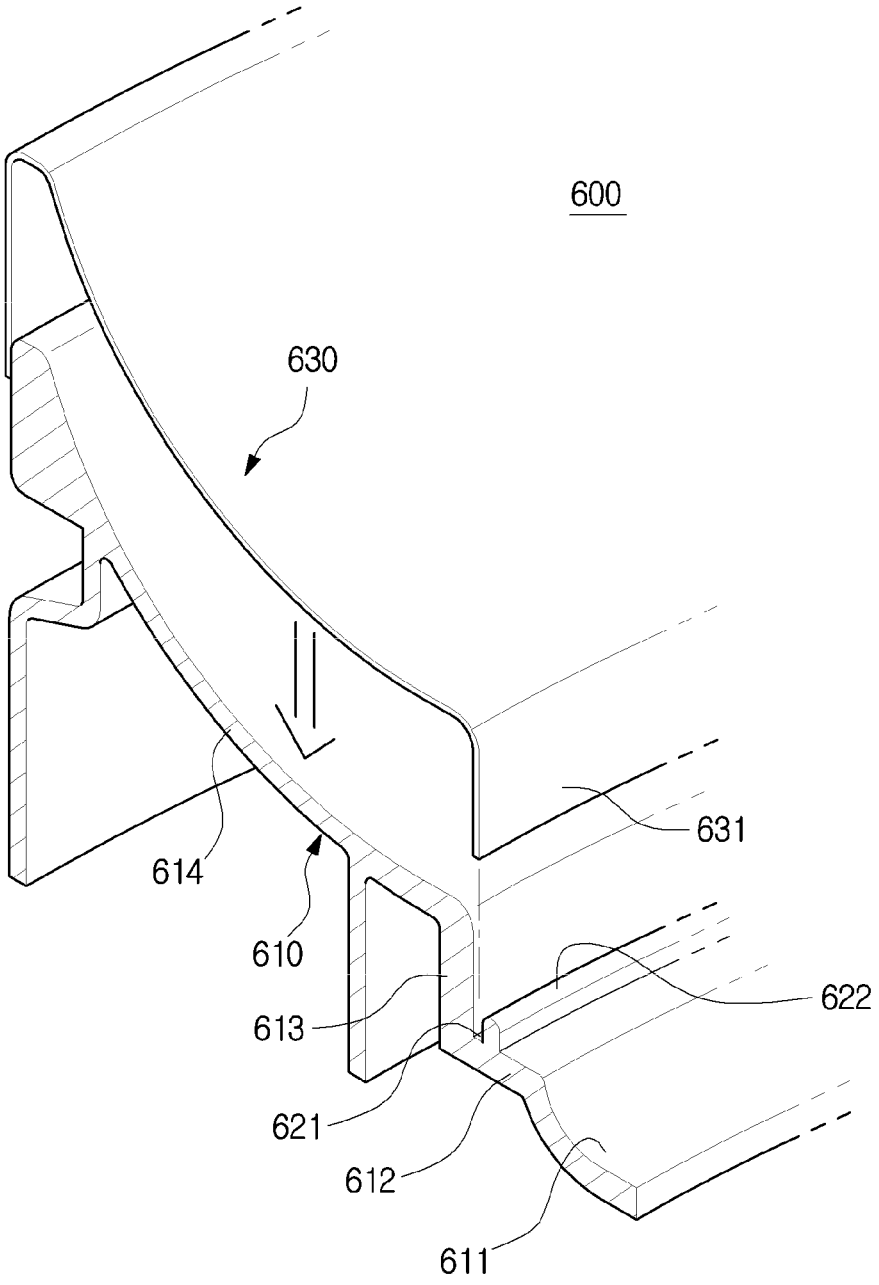

【Fig. 14】
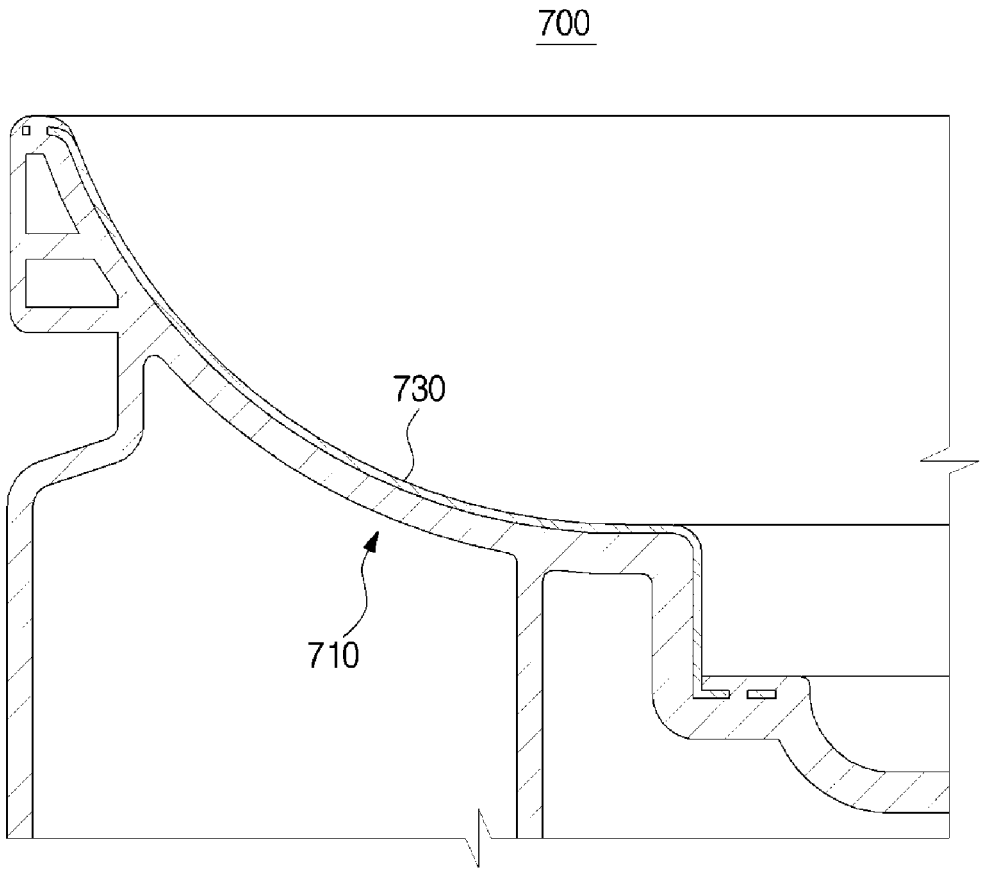

【Fig. 15】
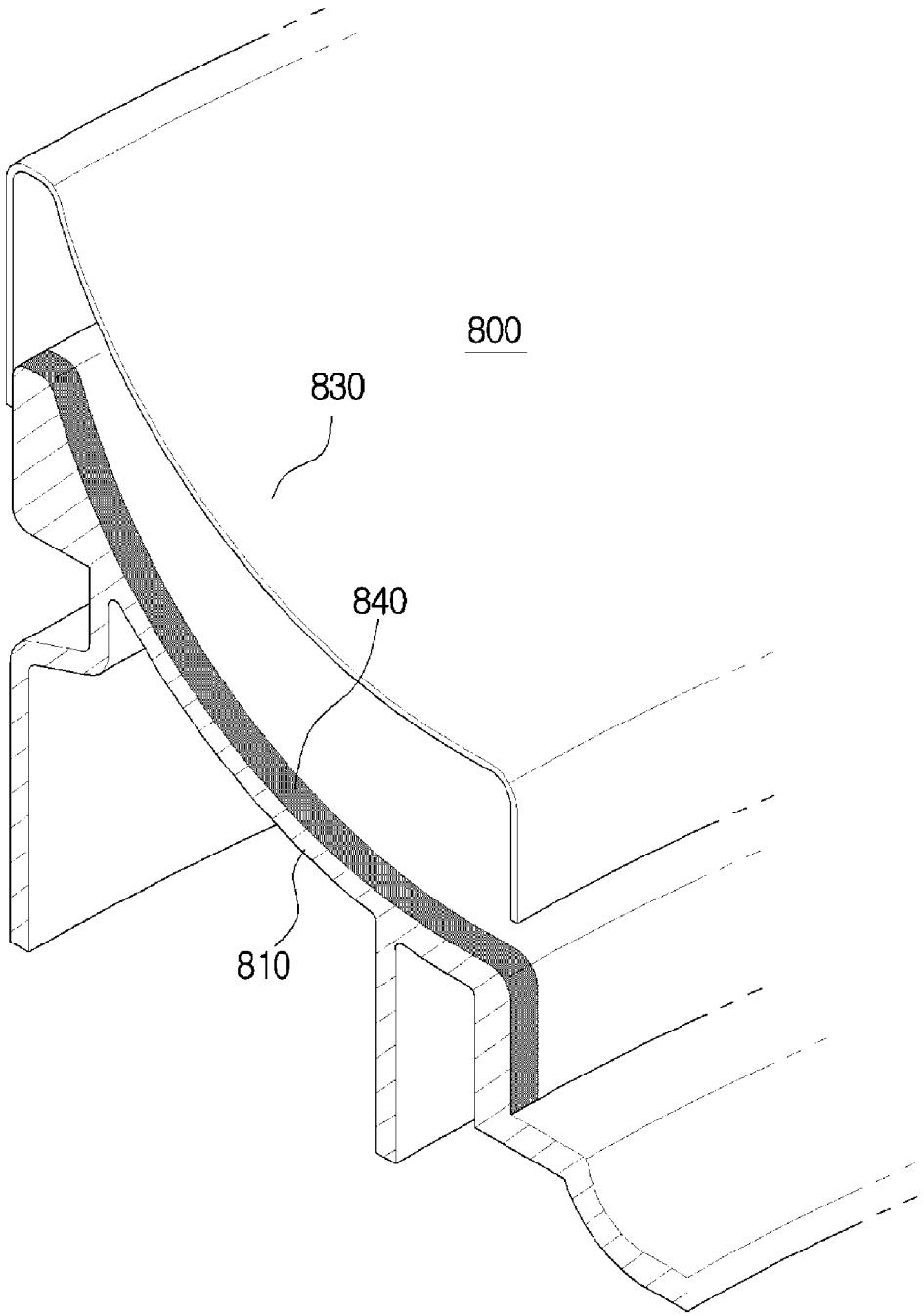

【Fig. 16】
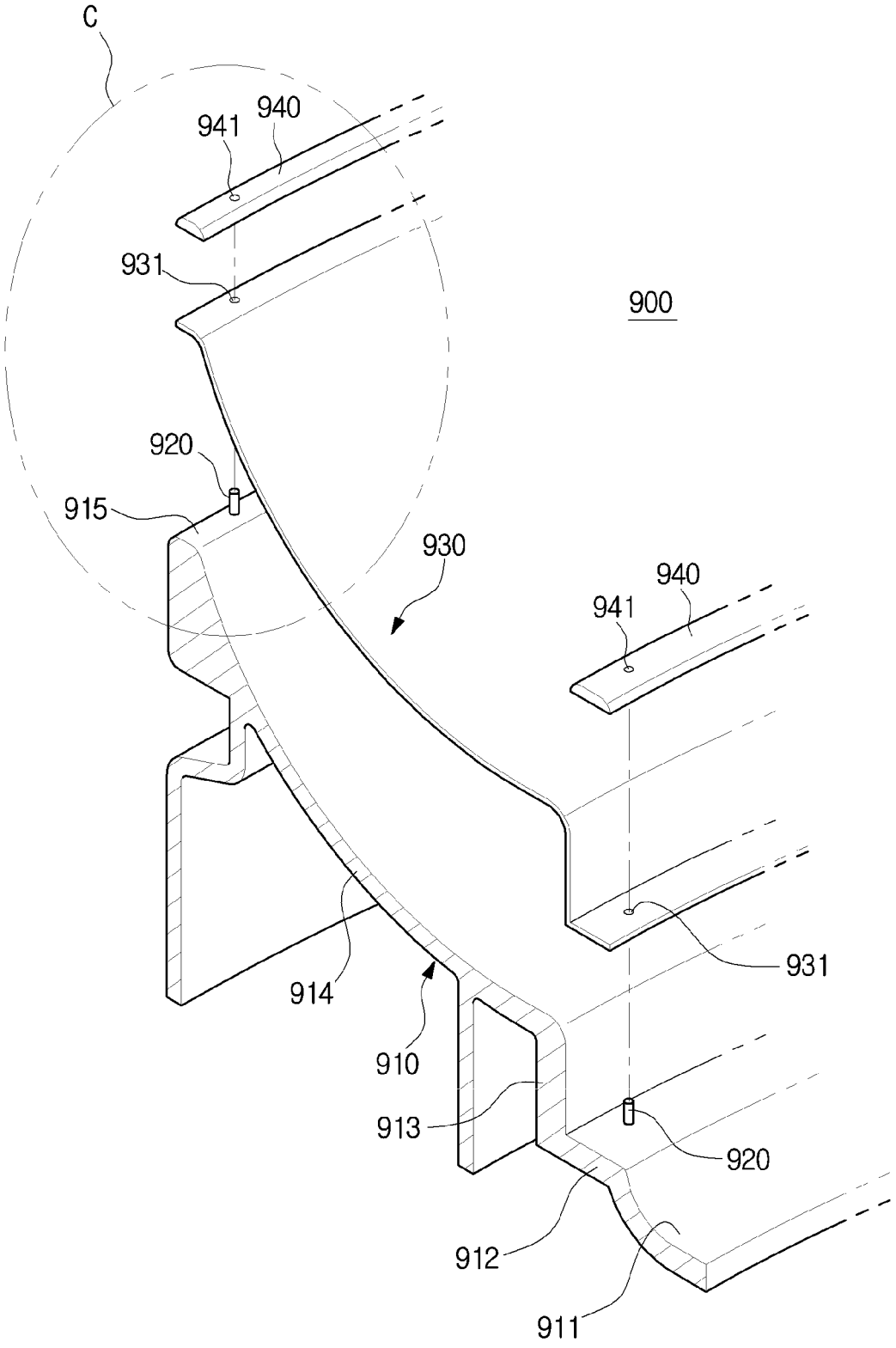

【Fig. 17】
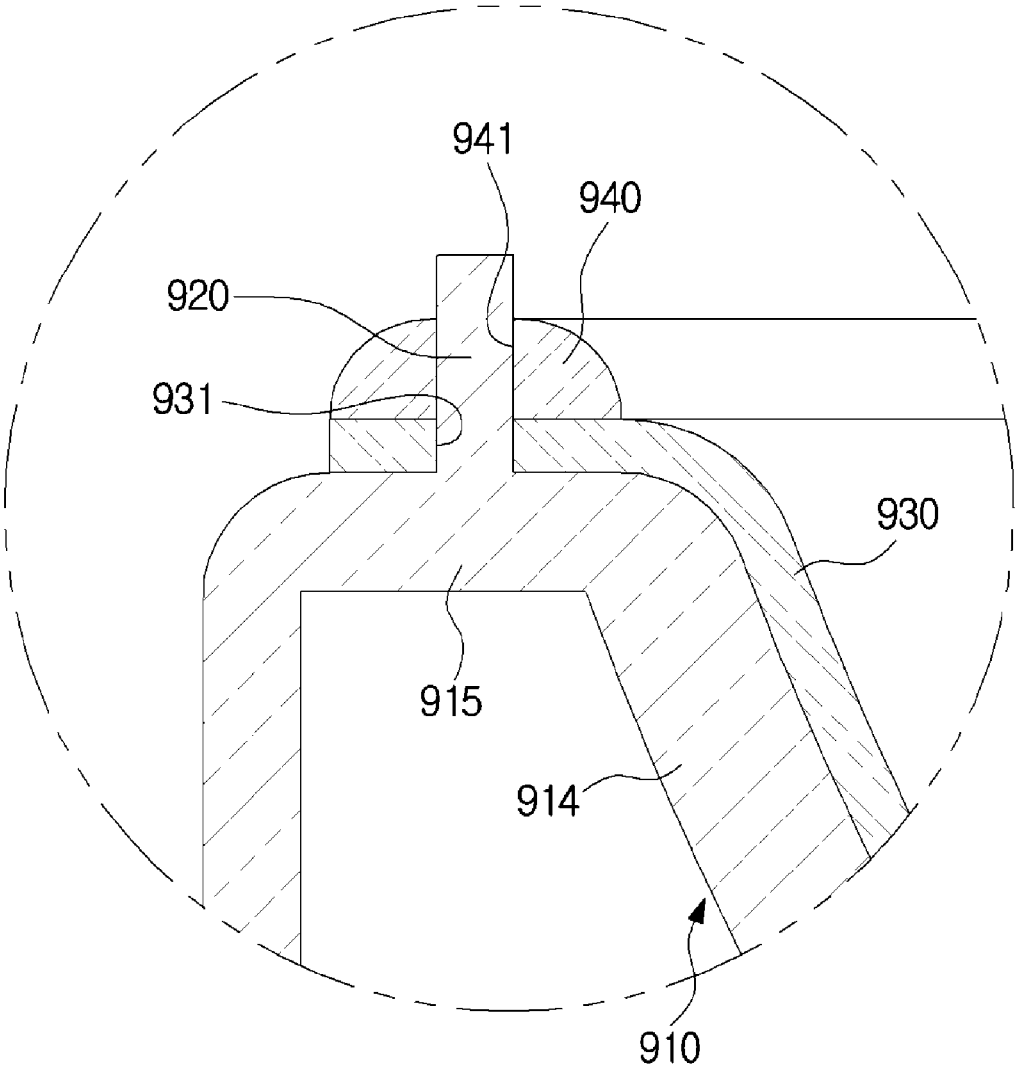

【Fig. 18】
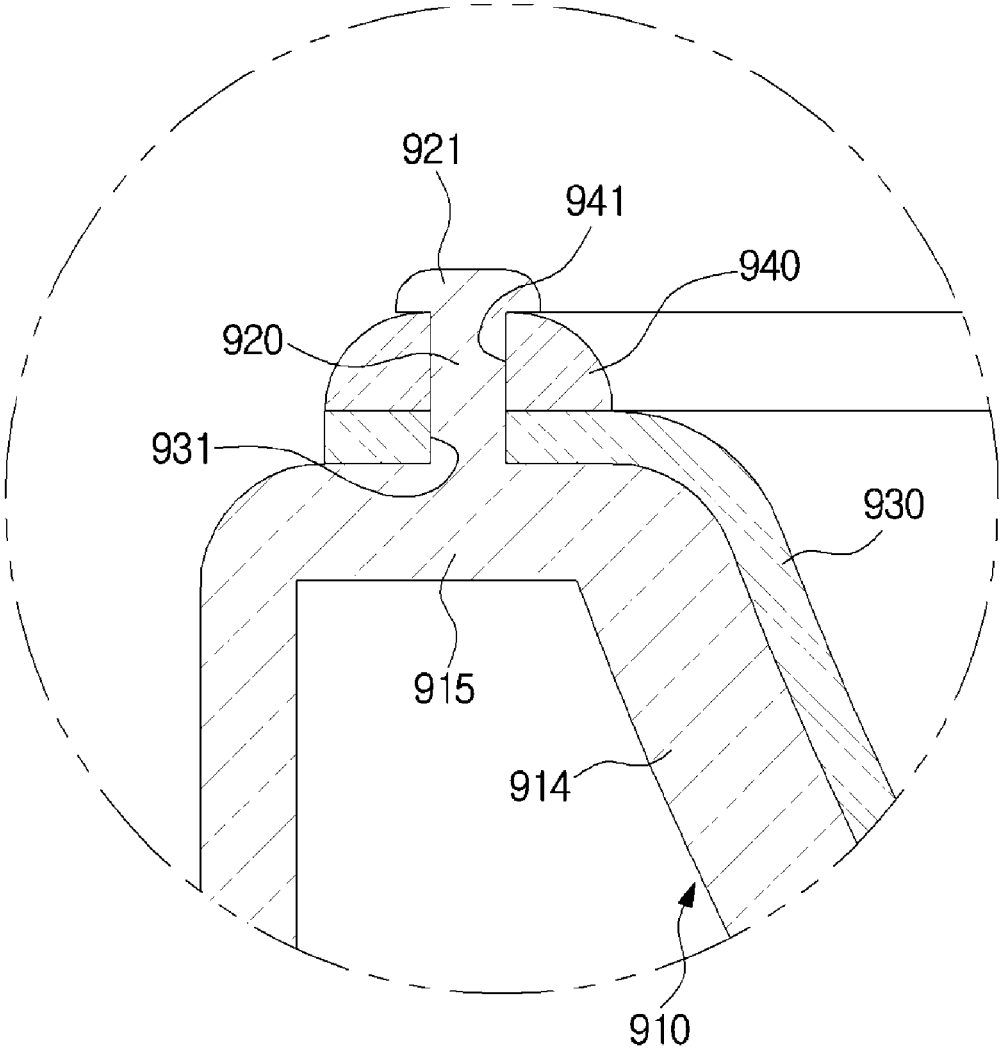

【Fig. 19】
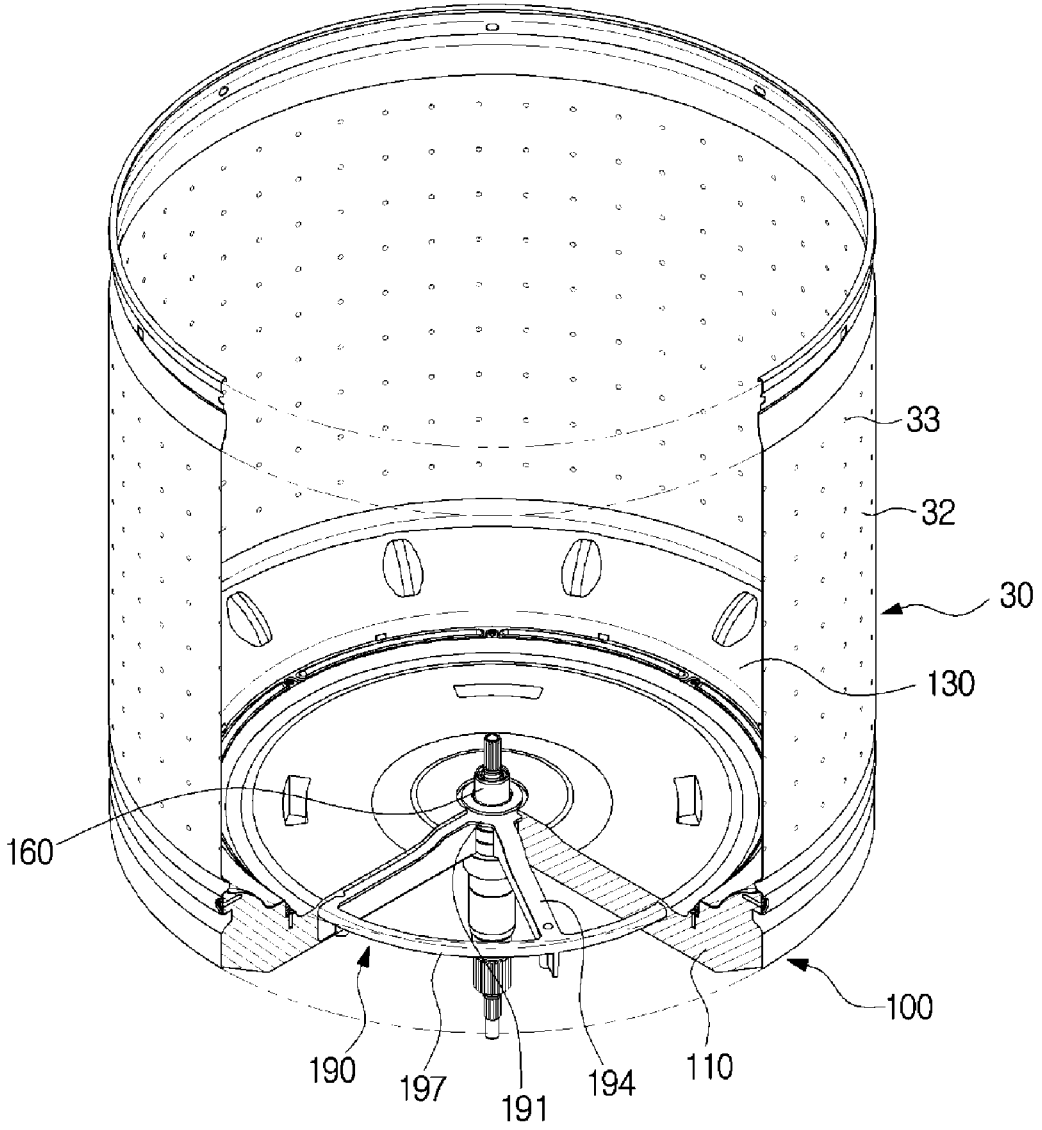

【Fig. 20】
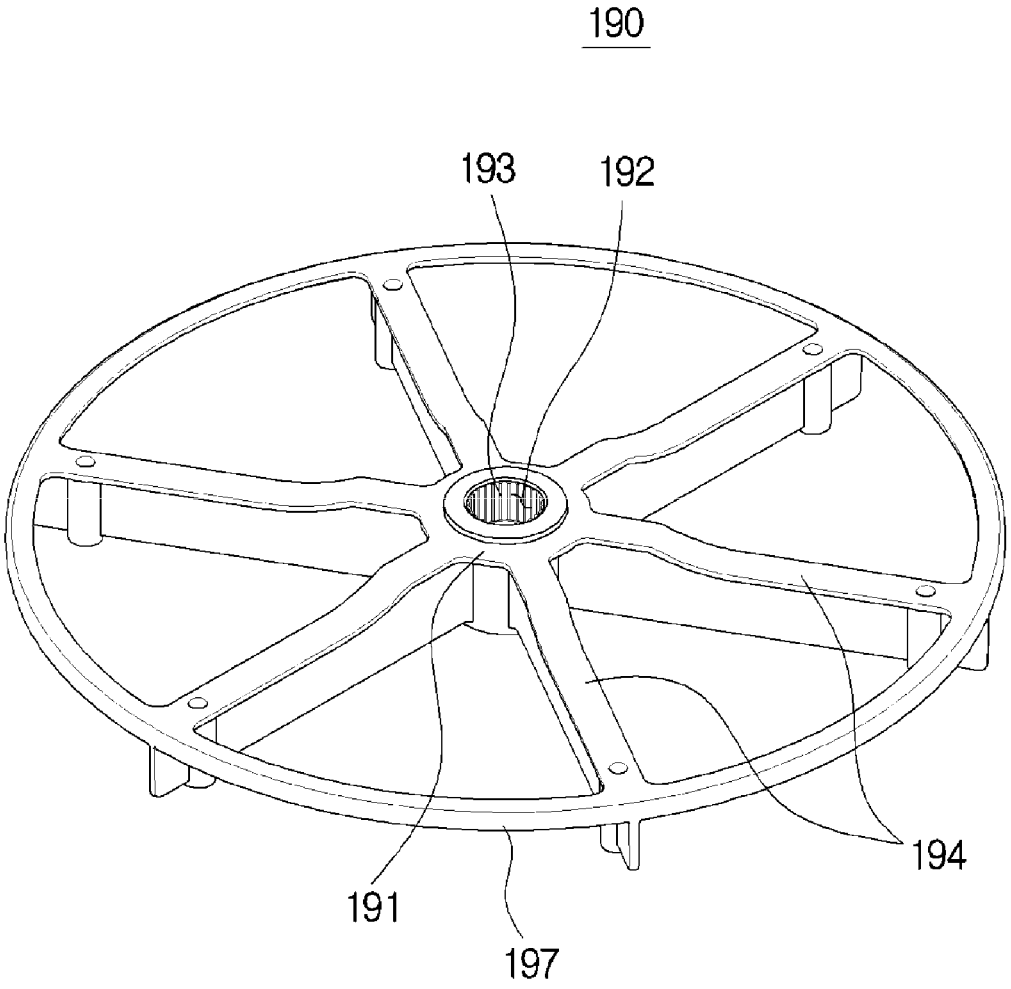

【Fig. 21】
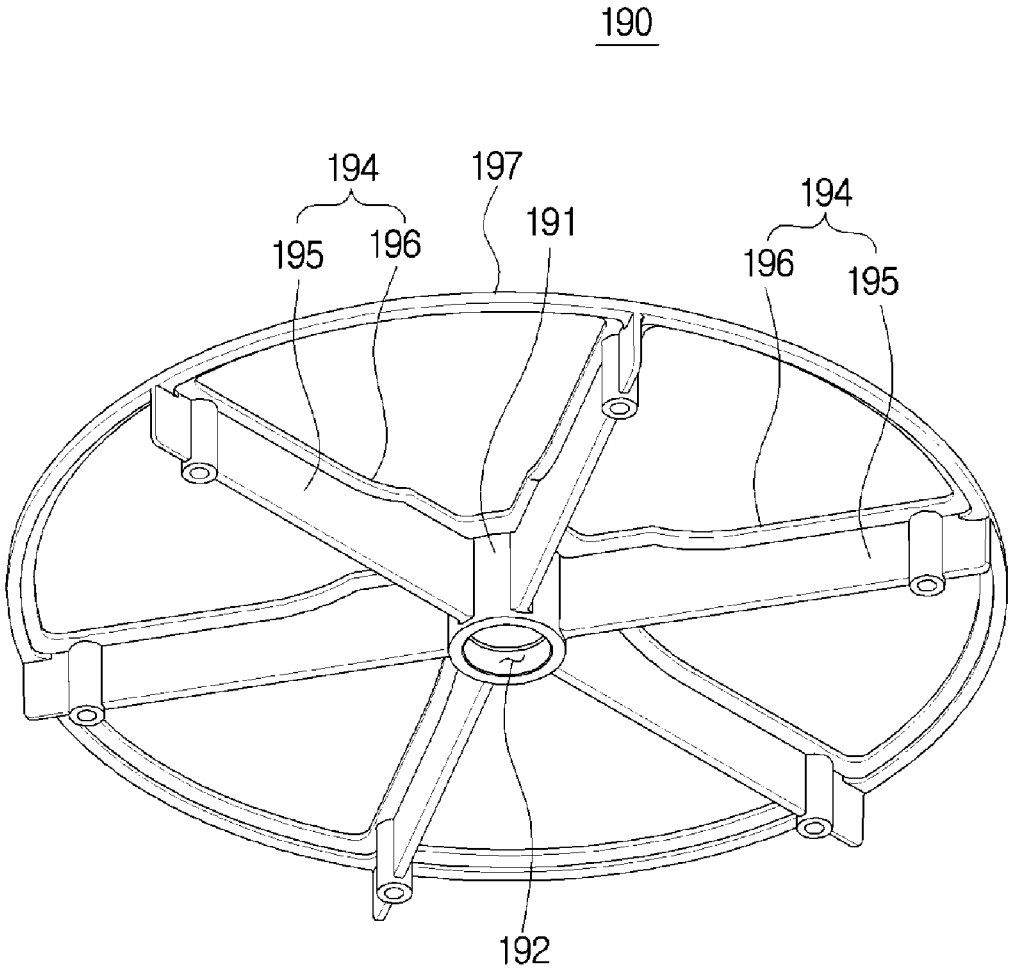

【Fig. 22】
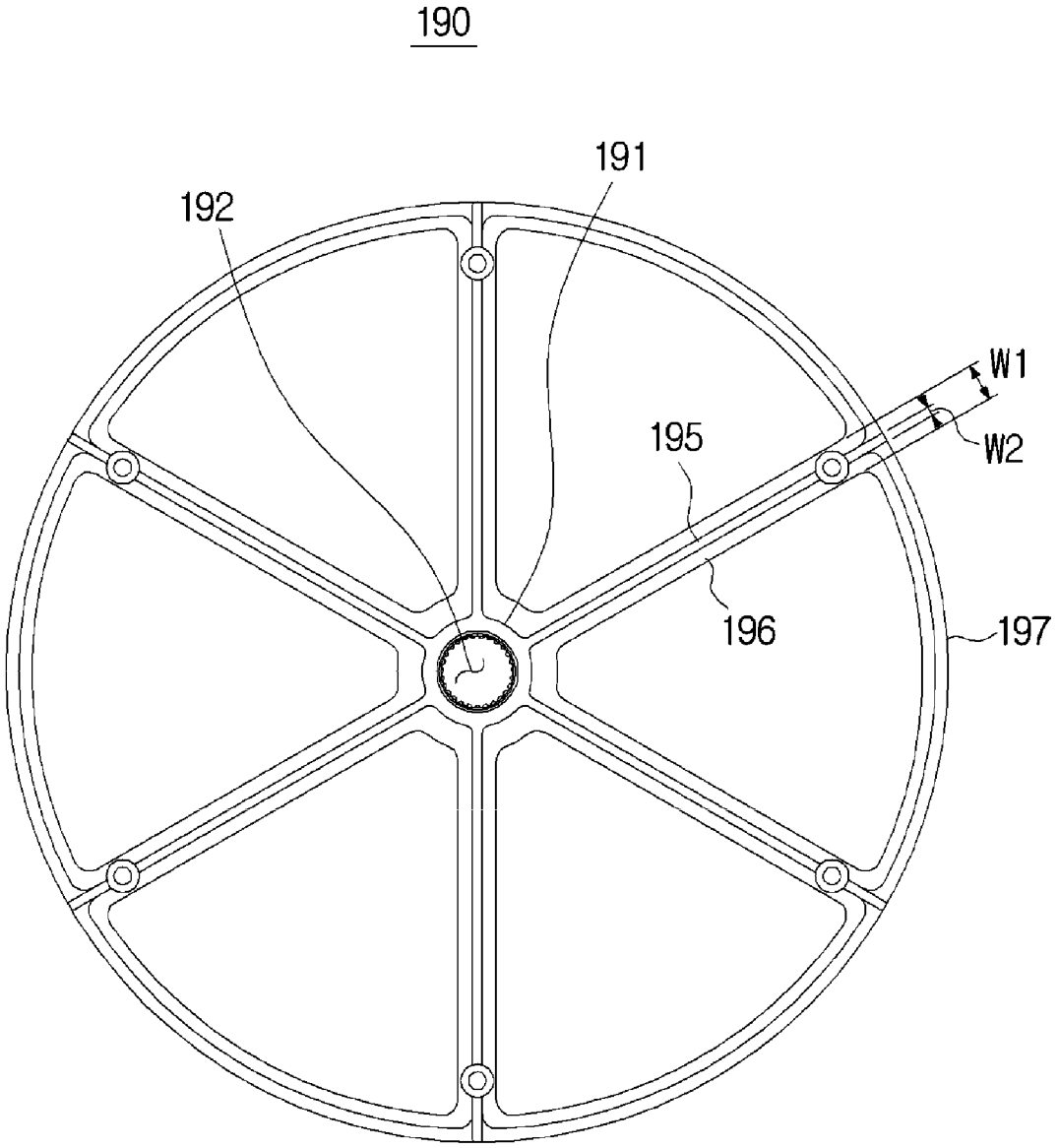

【Fig. 23】
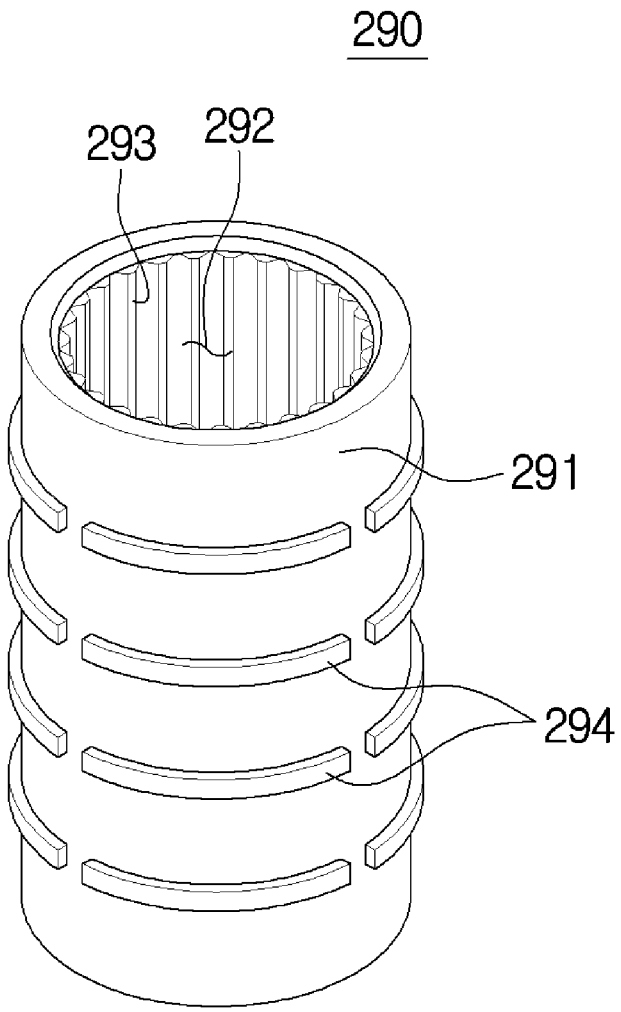

【Fig. 24】
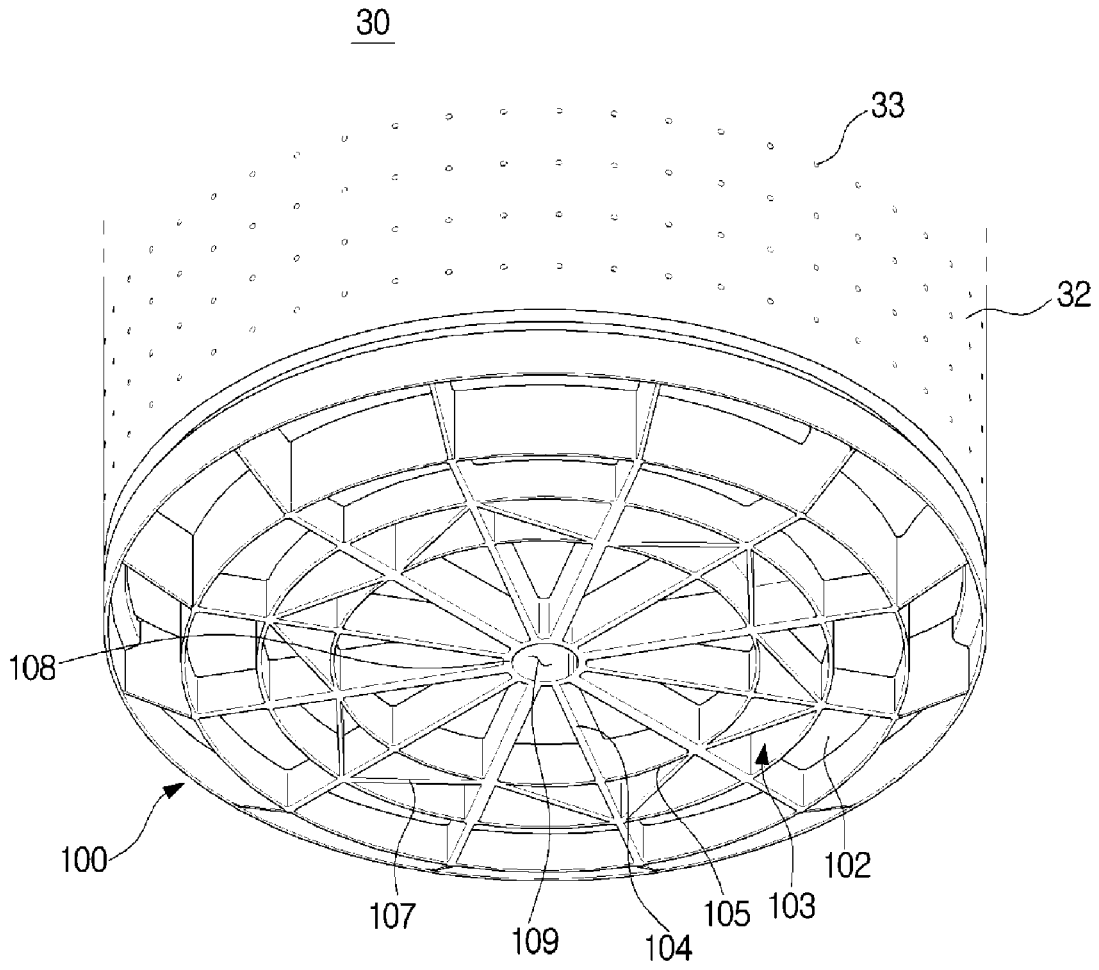

【Fig. 25】
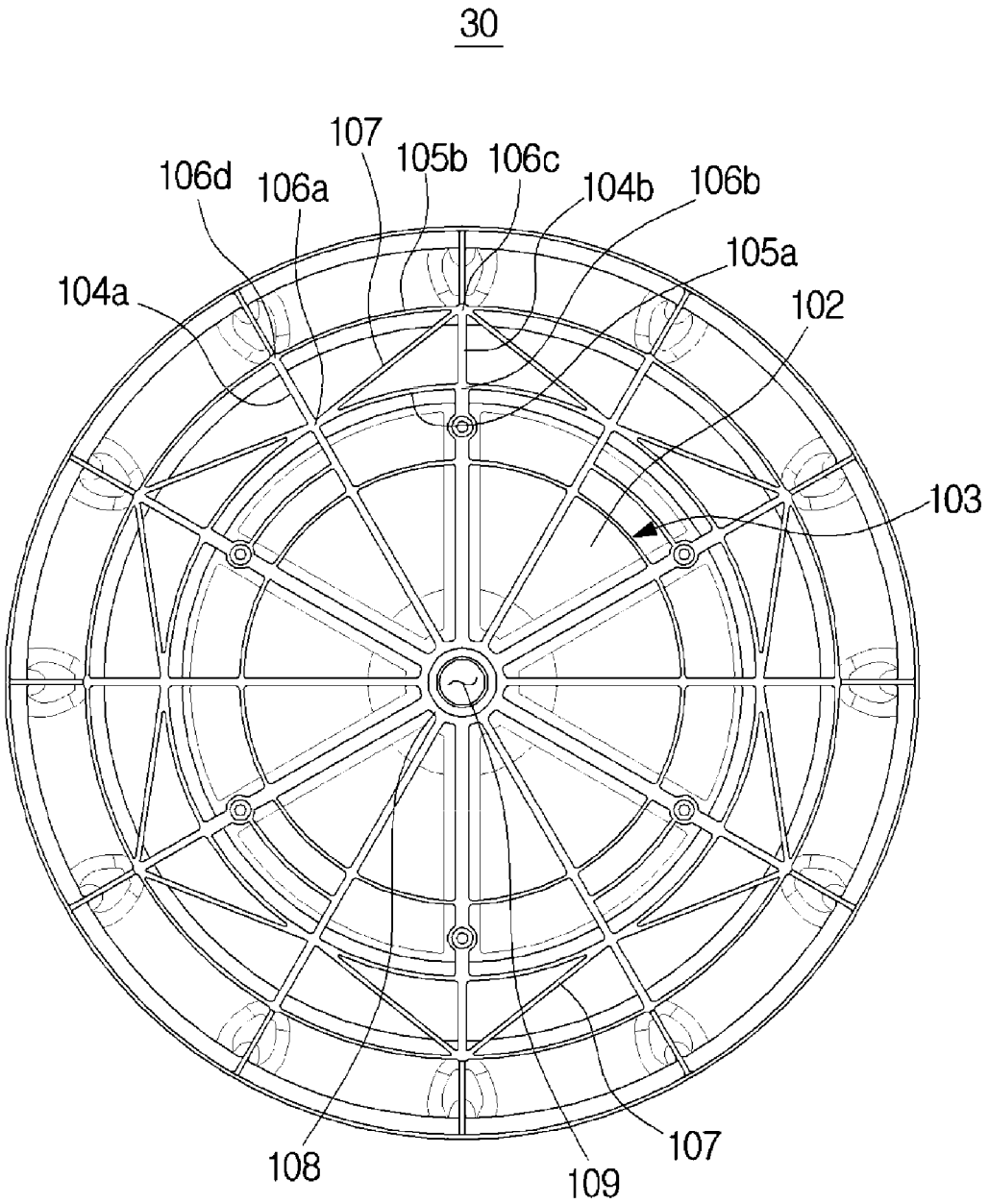

【Fig. 26】
20
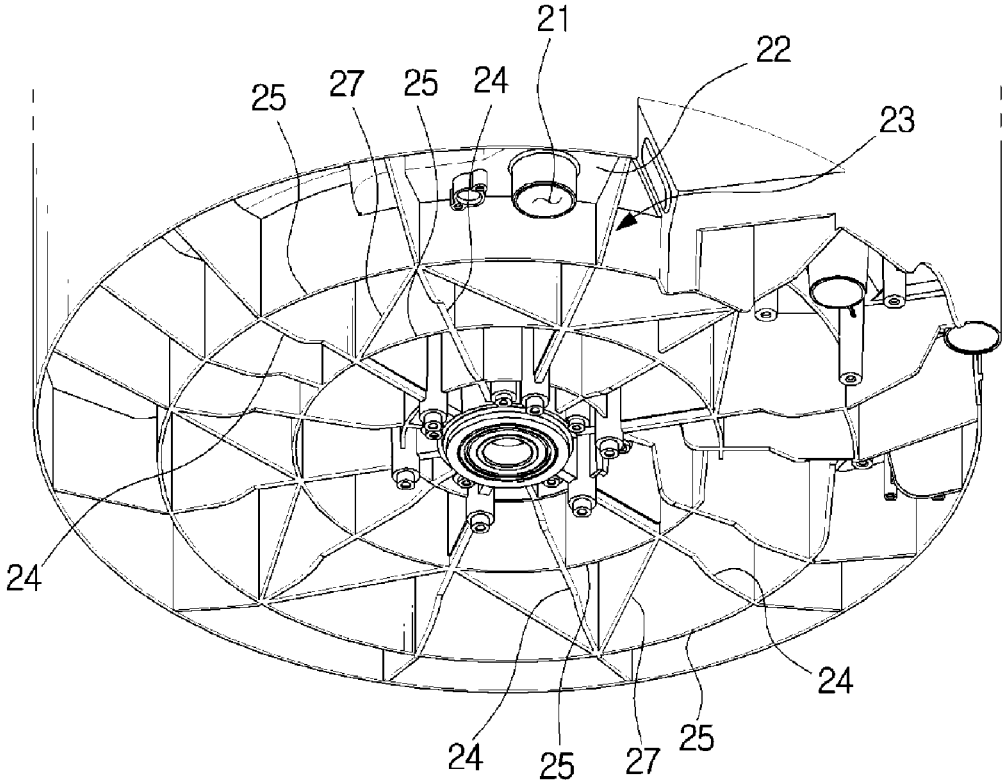

【Fig. 27】
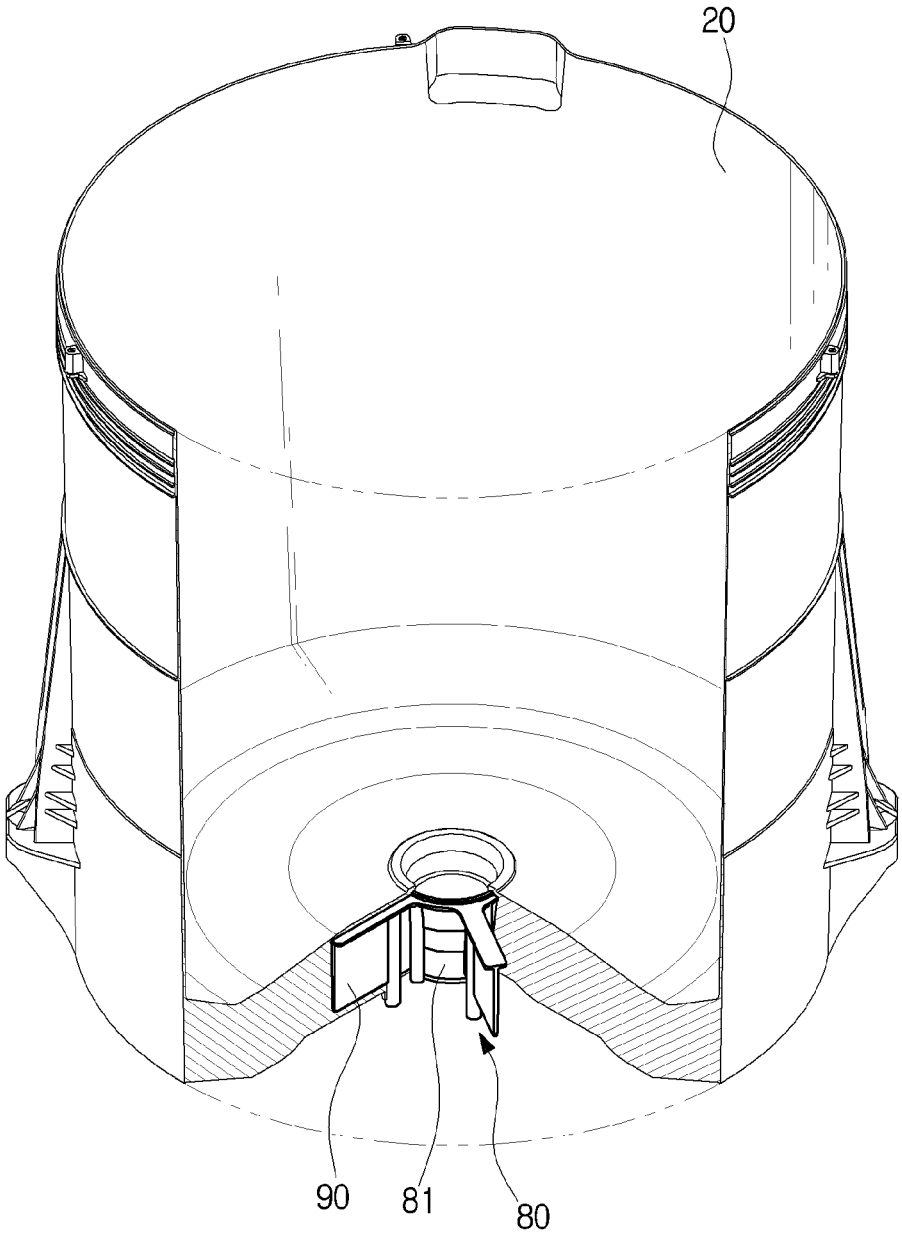

【Fig. 28】
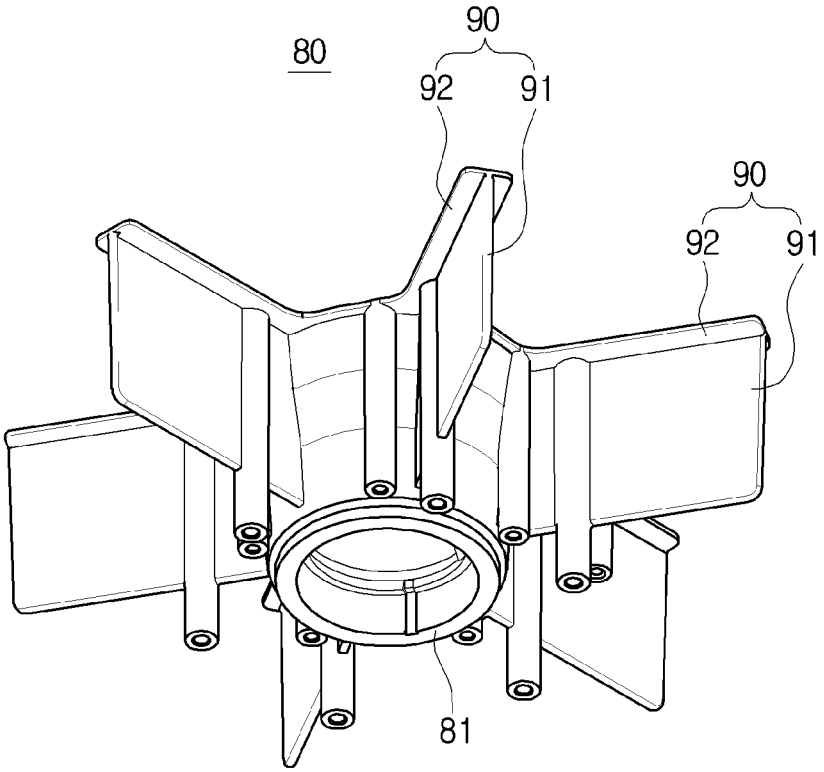

【Fig. 29】
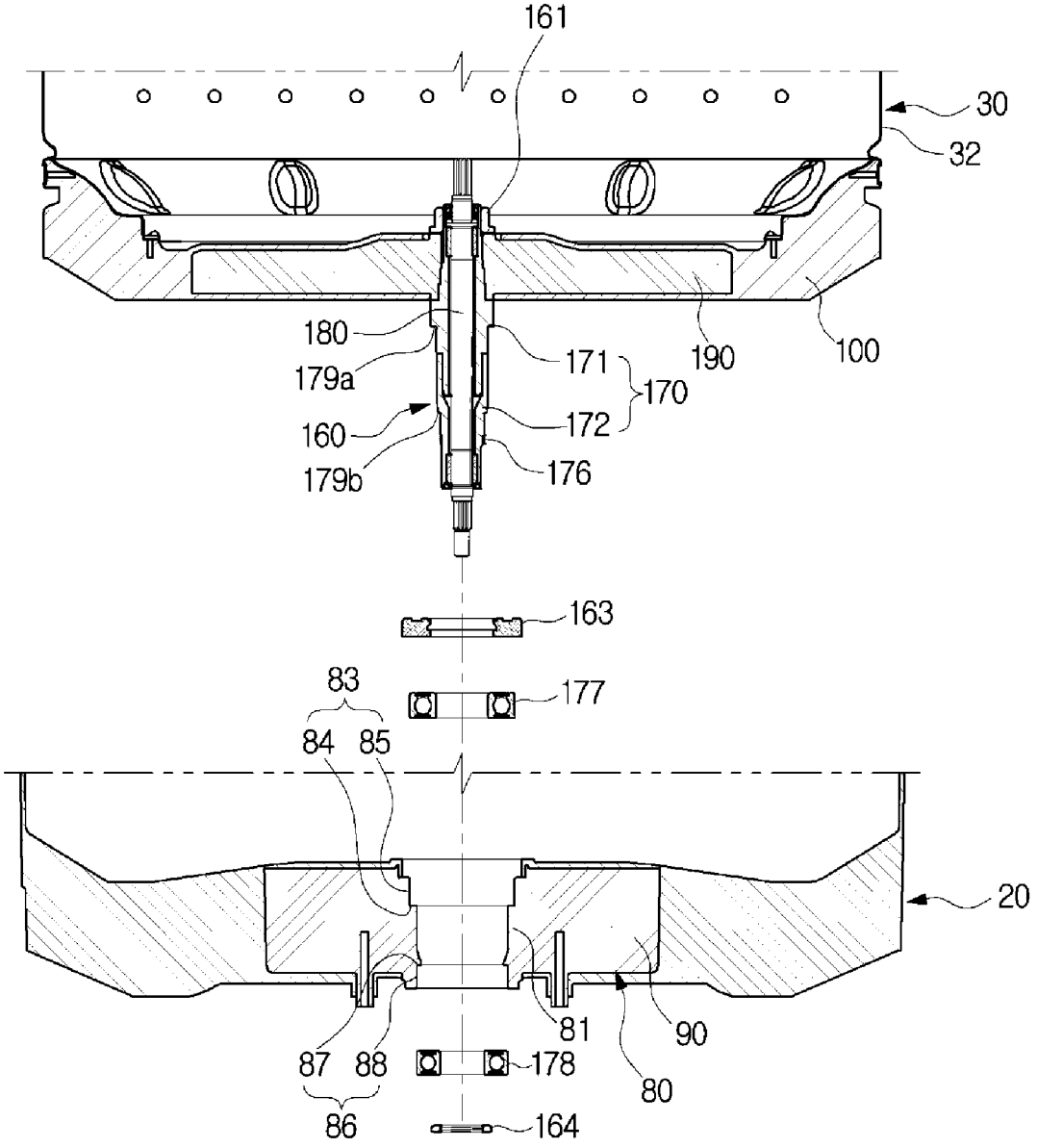

【Fig. 30】
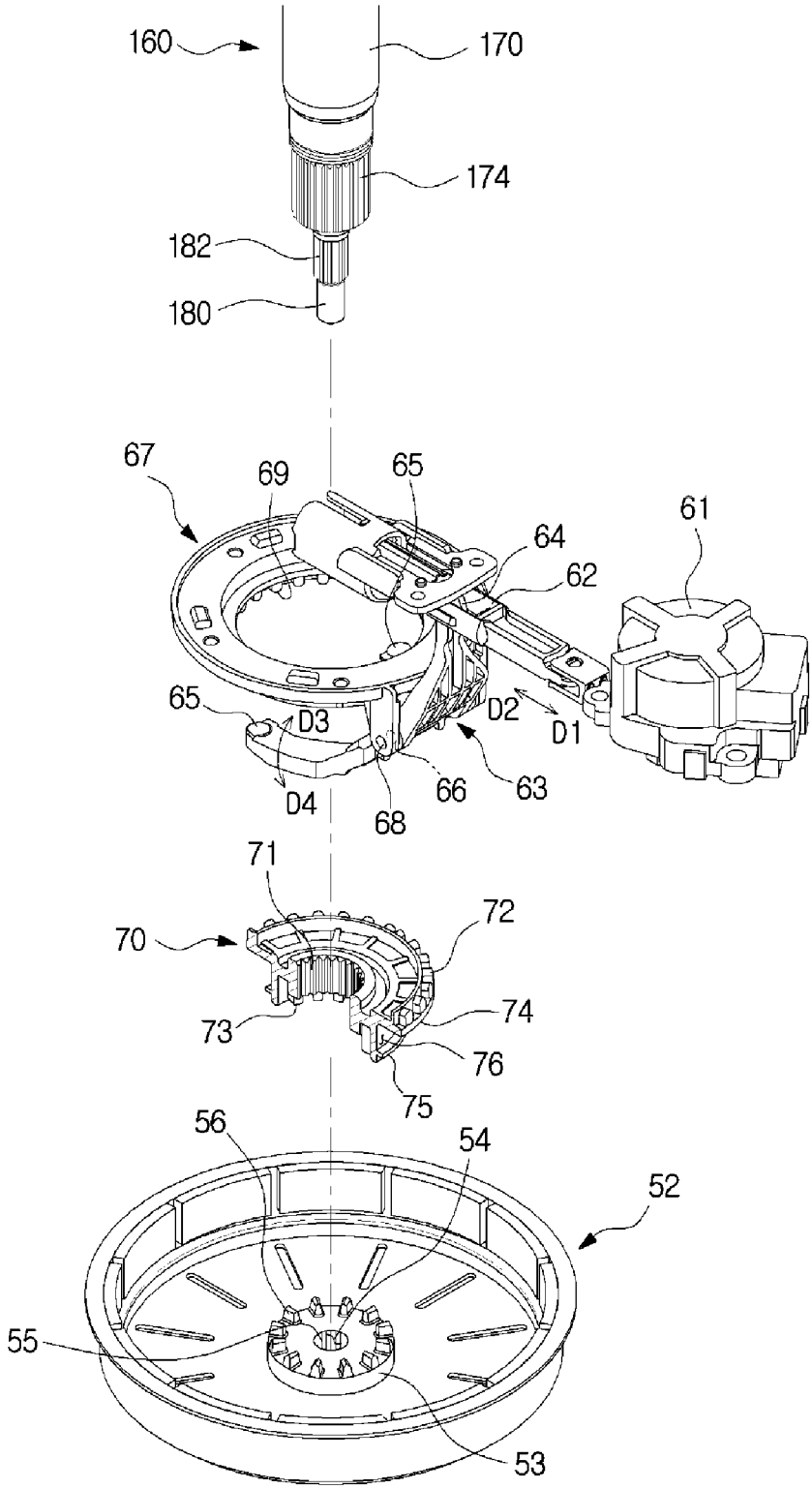

【Fig. 31】
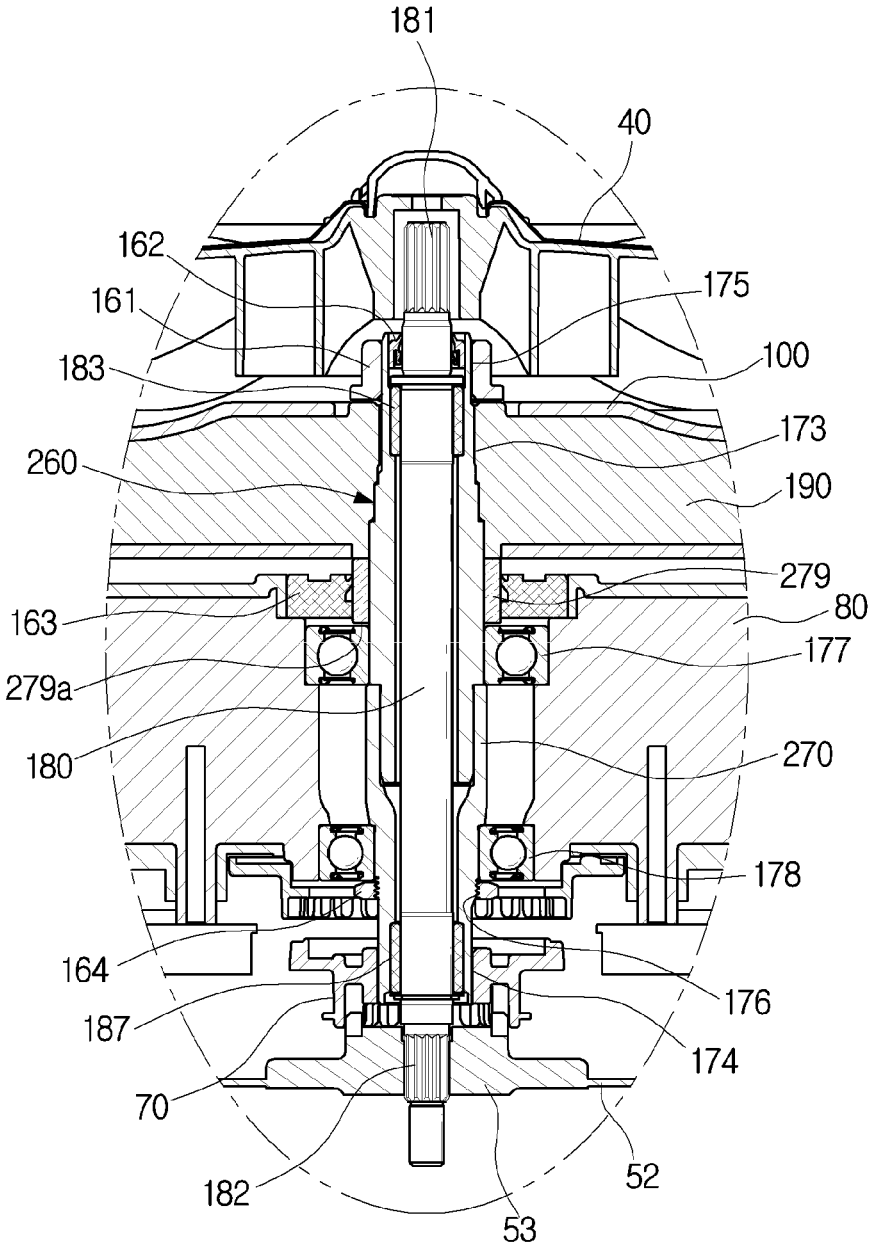

LAUNDRY MACHINE

CROSS-REFERENCE TO RELATED APPLICATIONS AND CLAIM OF PRIORITY

The present application claims benefit under 35 U.S.C. § 365 and is a 371 National Stage of International Application No. PCT/KR2016/008843 filed Aug. 11, 2016, which claims priority to Korean Patent Application No. 10-2015-0119275 filed Aug. 25, 2015, the disclosures of which are fully incorporated herein by reference into the present disclosure as if fully set forth herein.

TECHNICAL FIELD

The present disclosure relate to a washing machine, more particularly, to a rotating tub, a tub, and a shaft system provided in a top loading vortex type washing machine.

BACKGROUND

A washing machine is a home appliance for washing clothes using electric power, and it can be classified into the vortex type washing machine and the drum type washing machine according to the washing method.

The vortex type washing machine generates the water flow by the rotation of a pulsator provided in a rotating tub, and washes laundry by the generated water flow. Generally, the vortex type washing machine has a top loading structure in which an opening is provided in the upper portion of a body to put the laundry into the rotating tub.

The drum type washing machine is configured to wash laundry by lifting and falling the laundry by using a lifter formed in at inner circumferential surface of a rotating tub. Generally, the drum type washing machine has a front loading structure in which an opening is provided in a side surface of a body to put the laundry into the rotating tub.

The top loading vortex type washing machine is provided with two rotary members such as the rotating tub and the pulsator in the tub. Therefore, a shaft system is formed by a spin-dry shaft configured to supply a rotational force to the rotating tub and a washing shaft configured to supply a rotational force to the pulsator.

The rotating tub includes a cylindrical portion provided in a cylindrical shape, a bowl portion coupled to a lower portion of the cylindrical portion, and a balancing portion coupled to an upper portion of the cylindrical portion. Generally, the cylindrical portion may be formed of a thin steel plate and the bowl portion is formed to have a thickness greater than a thickness of the cylindrical portion and formed of a steel material, which is the same as the cylindrical portion, or a plastic material.

When the bowl portion is formed of the steel material, the corrosion resistance, the hygiene and the durability may be secured and a user may feel the clean and the luxurious although the cost is high. Alternatively, when the bowl portion is formed of plastic material, the manufacturing cost may be low but a user may feel a slightly toughness.

SUMMARY

The present disclosure is directed to providing a washing machine capable of securing the corrosion resistance, the hygiene and the durability of a bowl portion of a rotating tub, and capable of reducing the manufacturing cost.

Further, the present disclosure is directed to providing a washing machine having a flange capable of more smoothly transmitting the rotational force and capable of securing the strength of a bowl portion of a rotating tub.

Further, the present disclosure is directed to providing a washing machine having an improved reinforcing rib structure capable of reinforcing the strength of a rotating tub and a tub.

Further, the present disclosure is directed to providing a washing machine having a shaft system capable of being easily assembled or disassembled and capable of reducing the manufacturing cost.

A washing machine comprising:

In accordance with one aspect of the present disclosure, a washing machine include a body; and a rotating tub rotatably installed in the inside of the body and provided with a cylindrical portion formed in the cylindrical shape and a bowl portion coupled to a lower portion of the cylindrical portion, the bowl portion may include a main member formed of a resin material and a cover member coupled to an upper surface of the main member and formed of a metal material, the cover member may include a first engaging portion to be coupled to the main member, and the main member comprises a second engaging portion coupled to the first engaging portion.

The first engaging portion may include an outer curling portion formed such that an outer circumferential portion of the cover member is bent in the radially inward direction, and the second engaging portion may include an outer curling protrusion protruded to be covered by the outer curling portion so as to be coupled to the outer curling portion.

The first engaging portion may include an inner curling portion formed such that an inner circumferential portion of the cover member is bent in the radially outward direction, and the second engaging portion may include an inner curling protrusion protruded to be covered by the inner curling portion so as to be coupled to the inner curling portion.

The inner curling protrusion may include a reversely inclined portion formed to be inclined in the radially outward direction as being downward.

The first engaging portion may include an outer through hole formed in an outer circumferential portion of the cover member so that a coupling member penetrates from radially outward to radially inward, and the second engaging portion may include an outer fastening hole to which the coupling member is coupled.

The first engaging portion may include an inner through hole formed in an inner circumferential portion of the cover member so that a coupling member penetrates from the upper side to the lower side, and the second engaging portion may include an inner fastening hole to which the coupling member is coupled.

The bowl portion may include a plurality of foreign material prevention protrusions provided at a constant interval along the circumferential direction to prevent foreign materials from falling, and the coupling member may be arranged among the foreign material prevention protrusions.

The first engaging portion may include a locking hole and the second engaging portion may include a locking hook configured to protrude to be locked by being inserted into the locking hole.

The first engaging portion may include an insertion portion and the second engaging portion may include an insertion groove into which the insertion portion is inserted.

The first engaging portion may include a heat-sealing hole and the second engaging portion may include a heat-sealing protrusion configured to pass through the heat-sealing hole and when the heat is applied, configured to be blunt to be locked by the heat-sealing hole.

The cover member may be formed in a donut shape.

The first engaging portion may be provided in the inner circumferential portion and the outer circumferential portion.

Since a bowl portion of a rotating tub is formed such that a main member formed of a plastic material is coupled to a cover member of a metal material, the corrosion resistance, the hygiene and the durability are secured and a user can feel the cleanness and the luxurious while the manufacturing cost is reduced.

Since a flange, which is coupled to a bowl portion of a rotating tub to transmit the rotational force of a spin-dry shaft, is inserted into a main member of the bowl portion of the rotating tub to be integrally formed, the strength of the bowl portion of the tub can be strengthened, and thus the rotational force can be more smoothly transmitted.

The strength of the rotating tub and the tub can be reinforced by using a smaller amount of the resin.

The assembly and disassembly of the shaft system can be facilitated and the cost of the shaft system can be reduced.

BRIEF DESCRIPTION OF THE DRAWINGS

FIG. 1 is a cross-sectional view schematically illustrating a washing machine in accordance with an embodiment.

FIG. 2 is an enlarged-view illustrating "A" of FIG. 1, particularly, a view illustrating a shaft system in accordance with an embodiment.

FIG. 3 is an exploded view illustrating a rotating tub of the washing machine of FIG. 1.

FIG. 4 is a view illustrating a coupling structure of a cylindrical portion and a bowl portion in accordance with a first embodiment.

FIG. 5 is a cross-sectional view taken along a line I-I of FIG. 4.

FIG. 6 is an enlarged view illustrating B of FIG. 5, particularly illustrating a relationship between a foreign material prevention protrusion and a coupling member.

FIG. 7 is a cross-sectional view (including a pulsator) taken along a line II-II of FIG. 4.

FIG. 8 is a cross-sectional view illustrating a coupling structure of a main member and a cover member of a bowl portion in accordance with a second embodiment of the present disclosure.

FIG. 9 is a cross-sectional view illustrating a coupling structure of a main member and a cover member of a bowl portion in accordance with a third embodiment of the present disclosure.

FIGS. 10 and 11 are views illustrating a coupling structure of a main member and a cover member of a bowl portion in accordance with a fourth embodiment of the present disclosure.

FIG. 12 is a view illustrating a coupling structure of a main member and a cover member of a bowl portion in accordance with a fifth embodiment of the present disclosure.

FIG. 13 is a view illustrating a coupling structure of a main member and a cover member of a bowl portion in accordance with a sixth embodiment of the present disclosure.

FIG. 14 is a view illustrating a coupling structure of a main member and a cover member of a bowl portion in accordance with a seventh embodiment of the present disclosure.

FIG. 15 is a view illustrating a coupling structure of a main member and a cover member of a bowl portion in accordance with an eighth embodiment of the present disclosure.

FIG. 16 is a view illustrating a coupling structure of a main member and a cover member of a bowl portion in accordance with a ninth embodiment of the present disclosure.

FIGS. 17 and 18 are enlarged views of C portion of FIG. 16, particularly, a view illustrating a coupling structure of a heat-sealing protrusion and a heat-sealing hole.

FIG. 19 is a partial cross-sectional view illustrating a structure in which the flange is inserted in the main member of the bowl portion in accordance with an embodiment of the present disclosure.

FIG. 20 is a perspective view illustrating the flange in accordance with an embodiment of the present disclosure.

FIG. 21 is a bottom perspective view illustrating the flange in accordance with one embodiment of the present disclosure.

FIG. 22 is a bottom view illustrating the flange in accordance with an embodiment of the present disclosure.

FIG. 23 is a view illustrating a flange in accordance with another embodiment of the present disclosure.

FIGS. 24 and 25 are views illustrating a reinforcing rib of the rotating tub in accordance with an embodiment of the present disclosure.

FIG. 26 is a view illustrating a reinforcing rib of the tub in accordance with an embodiment of the present disclosure.

FIG. 27 is a partial cross-sectional view illustrating a structure in which the bearing housing is inserted into the inside of the tub in accordance with an embodiment of the present disclosure.

FIG. 28 is a view illustrating the bearing housing in accordance with an embodiment of the present disclosure.

FIG. 29 is a view illustrating a method of assembling the shaft system in accordance with an embodiment of the present disclosure.

FIG. 30 is a view illustrating the clutch device in accordance with an embodiment of the present disclosure.

FIG. 31 is a view illustrating a shaft system according to another embodiment of the present disclosure.

DETAILED DESCRIPTION

Exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

Throughout the disclosure, like reference numerals refer to like parts throughout the various figures and embodiments of the present disclosure. The size and thickness of each component illustrated in the drawings are arbitrarily shown for understanding and ease of description, but the present disclosure is not limited thereto. Thicknesses of several portions and regions are enlarged for clear expressions.

All terms including descriptive or technical terms which are used herein should be construed as having meanings that are obvious to one of ordinary skill in the art. However, the terms may have different meanings according to an intention of one of ordinary skill in the art, precedent cases, or the appearance of new technologies.

Also, some terms may be arbitrarily selected by the applicant, and in this case, the meaning of the selected terms will be described in detail in the detailed description of the present disclosure. Thus, the terms used herein have to be defined based on the meaning of the terms together with the description throughout the specification.

It will be understood that, although the terms first, second, third, etc., may be used herein to describe various elements, but is should not be limited by these terms. These terms are only used to distinguish one element from another element.

The singular forms "a," "an" and "the" are intended to include the plural forms as well, unless the context clearly indicates otherwise.

In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

Hereinafter embodiments of the present disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

<Overview>

FIG. 1 is a cross-sectional view schematically illustrating a washing machine in accordance with an embodiment. FIG. 2 is an enlarged-view illustrating "A" of FIG. 1, particularly, a view illustrating a shaft system in accordance with an embodiment. FIG. 3 is an exploded view illustrating a rotating tub of the washing machine of FIG. 1.

A washing machine will be described in accordance with an embodiment of the present disclosure with reference to FIGS. 1 to 3.

The washing machine 1 may include a body 10, a tub 20 provided inside the body 10 to store washing water, a rotating tub 30 rotatably provided in the tub 20 to accommodate laundry, and a pulsator 40 rotatably provided in the rotating tub 30 to generate a water flow.

The body 10 may include a cabinet 11 and a top cover 12 coupled to an upper portion of the cabinet 11. In an upper portion of the top cover 12, an inlet 13 may be provided to put laundry into the rotating tub 30. On a front surface of the top cover 12, a control panel 16 may be provided to display operation information of the washing machine 1 and receive an operation command.

The tub 20 may be provided in a cylindrical shape having an upper surface opened. The tub 20 may be supported by a suspension 14. According to another embodiment, a tub may be omitted in the washing machine and only the rotating tub may be provided. In this case, washing water and laundry may be accommodated in the rotating tub.

In a lower portion of the tub 20, a drain port 21 (refer to FIG. 26) may be provided to discharge washing water stored in the tub 20 to the outside of the tub 20.

The rotating tub 30 may be rotatably provided inside the tub 20 to accommodate the laundry. The rotating tub 30 may include a cylindrical portion 32 provided in a cylindrical shape, a bowl portion 100 coupled to a lower portion of the cylindrical portion 32, and a balancing portion 31 coupled to an upper portion of the cylindrical portion 32.

The cylindrical portion 32 may have a plurality of through holes 33 through which washing water can flow. The cylindrical portion 32 may be formed of a steel material.

The balancing portion 31 may eliminate the load imbalance caused by the laundry upon the rotation of the rotating tub 30. The balancing portion 31 may include a housing having an annular channel, and a ball or a fluid mass movably provided inside the channel. The balancing portion 31 may be a passive type in which the ball or the fluid is passively moved according to the rotation of the rotating tub 30, or an active type in which the mass has a driving force to move by itself.

The bowl portion 100 may be coupled to the lower portion of the cylindrical portion 32 and have a substantially dish shape. Since the bowl portion 100 receives a larger load than the cylindrical portion 32 due to the centrifugal force when the rotating tub 30 rotates, it is required that the bowl portion 100 is configured to have a higher stress than the cylindrical portion 32. For example, when the bowl portion 100 is formed of a material the same as the cylindrical portion 32, the bowl portion 100 may be needed to have a greater thickness than the cylindrical portion 32.

In the conventional manner, the bowl portion 100 is formed of a metal material such as stainless steel (SUS) or a resin material such as polypropylene.

The stainless steel (SUS) is an alloy steel in which nickel, chrome, etc. are added in iron, and it is excellent in the corrosion resistance, the hygiene, the durability, the abrasion resistance, the hardness and the strength. Accordingly, when the strength of the stainless steel (SUS) and the strength of the resin are the same, the bowl portion 100 may have a relatively small thickness. In addition, as for the appearance, the stainless steel (SUS) has a polished surface and neatness. Therefore, stainless steel (SUS) gives high user satisfaction. However, the cost is relatively higher than the resin material.

The resin material is less in the corrosion resistance, the hygiene, the durability, the abrasion resistance, the hardness and the strength, but has a relatively low cost in comparison with the stainless steel (SUS).

According to an embodiment, the bowl portion 100 may be formed such that a cover member 130 formed of a metal material covers an upper surface of a main member 110 formed of the resin material. Therefore, the bowl portion 100 may have advantages of material such as the corrosion resistance, the hygiene, the durability, and the aesthetics and at the same time the cost reduction corresponding to the advantages of the resin material may be achieved.

The cover member 130 may be configured to cover a portion of the upper surface of the main member 110. That is, the cover member 130 may cover a resting portion except the inner circumference covered by the pulsator 40 in the upper surface of the main member 110. Since the portion covered by the pulsator 40 is not directly exposed to the user, it is not needed to cover with the relatively expensive cover member 130.

However, unlike the present embodiment, the cover member 130 may be provided to cover an entire upper surface of the main member 110.

The cover member 130 and the main member 110 each have a first engaging portion and a second engaging portion for mutual engagement, and the first engaging portion and the second engaging portion may include various structures for engaging. A description thereof will be described later.

Further, the bowl portion 100 and the cylindrical portion 32 may be fastened to a coupling member, which will be described later.

The pulsator 40 may be rotatably provided in a lower portion of the rotating tub 30 to generate the water flow. The pulsator 40 may have a substantially disc shape.

The washing machine 1 may include a water supply device 2 configured to supply washing water to the inside of the tub 20. The water supply device 2 may include a water supply pipe 4 connected to an external water source to guide washing water to the tub 20 and a water supply valve 3 provided in the water supply pipe 4 to regulate the supply of water.

The washing machine 1 may include a detergent supply device (not shown) configured to supply the detergent. The water supply pipe 4 may be installed to pass through the detergent supply device so that the washing water together with the detergent is supplied to the tub 20.

The washing machine 1 may include a water discharge device (not shown) configured to discharge washing water of the tub 20 to the outside of the body 10. The water discharge device may include a water discharge pipe (not shown) connected to the drain port 21 of the tub 20, an opening and closing valve configured to open and close the water discharge pipe, or a water discharge pump configured to pump washing water of the tub 20.

The washing machine 1 may include a drive device configured to drive the rotating tub 30 and the pulsator 40.

The drive device includes a motor 50 switching the electric power to the mechanical torque and a shaft system transmitting the driving force generated by the motor 50 to the rotating tub 30 and pulsator 40.

The motor 50 includes a stator 51 and a rotor 52 configured to rotate by electromagnetically interacting with the stator 51.

The shaft system includes a shaft assembly 160, a clutch device 60, and a bearing housing 80. The shaft assembly 160 is provided with a hollow spin-dry shaft 170 configured to transmit the driving force generated by the motor 50 to the rotating tub 30 and a washing shaft 180 provided in the inside of the spin-dry shaft 170 to transmit the driving force generated by the motor 50 to the pulsator 40. The clutch device 60 is configured to connect or disconnect the motor 50 to the spin-dry shaft 170. The bearing housing 80 is configured to rotatably support the shaft assembly 160 to reinforce the strength of the tub 20.

The spin-dry shaft 170 may be formed such that an upper spin-dry shaft 171 is coupled to a lower spin-dry shaft 172. The upper spin-dry shaft 171 and the lower spin-dry shaft 172 may be precisely formed by a forging process such as polishing and turning. The upper spin-dry shaft 171 and the lower spin-dry shaft 172 may be coupled to each other by a hot rolling method.

A reason why the spin-dry shaft 170 is formed such that two pieces such as the upper spin-dry shaft 171 and the lower spin-dry shaft 172 are coupled to each other is to reduce the manufacturing cost by reducing the size of the basic material for the forging process, but is not limited thereto. Therefore, unlike the embodiment, the spin-dry shaft 170 may be formed by a single piece.

The spin-dry shaft 170 may include a spin-dry shaft upper serrated portion 173 configured to be coupled to a flange 190 described later, in a serrated manner, and a spin-dry shaft lower serrated portion 174 configured to be coupled to a coupling 70 of the clutch device 60 described later, in a serrated manner.

The spin-dry shaft 170 may include an upper nut engaging portion 175 to which an upper fixation nut 161 is coupled and a lower nut engaging portion 176 to which a lower fixation nut 164 is coupled.

The upper fixation nut 161 may allow the shaft assembly 160 to be strongly coupled to the flange 190 described later, particularly, the upper fixation nut 161 may prevent the shaft assembly 160 from slipping downward from the flange 190. The upper fixation nut 161 may be fixedly coupled to the spin-dry shaft 170 and supported by the flange 190.

The lower fixation nut 164 may allow the shaft assembly 160 to be strongly coupled to the bearing housing 80, particularly, the lower fixation nut 164 may prevent the shaft assembly 160 from slipping upward from the bearing housing 80. The lower fixation nut 164 may be coupled to the spin-dry shaft 170 and supported by a spin-dry shaft bearing 178 described later.

The spin-dry shaft bearing 177 and 178 rotatably supports the spin-dry shaft 170. The spin-dry shaft bearing 177 and 178 includes an upper spin-dry shaft bearing 177 and a lower spin-dry shaft bearing 178.

The spin-dry shaft bearing 177 and 178 is mounted to an inner circumferential surface of the bearing housing 80.

The washing shaft 180 is provided in the hollow of the spin-dry shaft 170. A washing shaft bearing 183 and 187 may be provided between an inner circumferential surface of the spin-dry shaft 170 and an outer circumferential surface of the washing shaft 180 so as to rotatably support the washing shaft 180. The washing shaft bearing 183 and 187 may be an oilless bearing or a ball bearing.

A washing shaft upper serrated portion 181 configured to be coupled to the pulsator 40, in a serrated manner may be provided in the upper portion of the washing shaft 180 and a washing shaft lower serrated portion 182 configured to be coupled to the rotor 52 of the motor 50, in a serrated manner may be provided in the lower portion of the washing shaft 180.

The rotor 52 may be provided with a hub portion 53 to be coupled to the washing shaft lower serrated portion 182.

In an upper portion of the upper spin-dry shaft bearing 177, an outer sealing member 163 may be provided to prevent moisture from introducing into the inside of the bearing housing 80. The outer sealing member 163 may be provided to surround an outer circumference of the spin-dry shaft 170.

Between the spin-dry shaft 170 and the washing shaft 180, an inner sealing member 162 may be provided to prevent moisture from introducing into between the spin-dry shaft 170 and the washing shaft 180.

The clutch device 60 transmits the driving force of the motor 50 to the spin-dry shaft 170 by connecting the motor 50 to the spin-dry shaft 170 or prevents the driving force of the motor 50 from transmitting to the spin-dry shaft 170 by releasing the connection between the motor 50 and the spin-dry shaft 170.

That is, the spin-dry shaft 170 may be connected or disconnected to the motor 50 by the clutch device 60. In contrast, the washing shaft 180 may be maintained to be connected to the motor 50.

Therefore, when the clutch device 60 releases the connection between the spin-dry shaft 170 and the motor 50, the power may be transmitted to only washing shaft 180 so that only pulsator 40 is rotated. When the clutch device 60 connects the spin-dry shaft 170 to the motor 50, the power may be transmitted to both of the spin-dry shaft 170 and the washing shaft 180 so that the rotating tub 30 and the pulsator 40 are simultaneously rotated.

When only pulsator 40 is rotated, the water flow may be generated by the rotation of the pulsator 40 and then the laundry may be rotated by the generated water flow while rubbing against the rotating tub 30, thereby performing the washing of the laundry.

When the rotating tub 30 and the pulsator 40 are simultaneously rotated, moisture of the laundry may be removed by the centrifugal force while the laundry placed in the rotating tub 30 is rotated, thereby performing the spin-dry of the laundry.

Particularly, the clutch device 60 includes the coupling 70 coupled to the spin-dry shaft lower serrated portion 174 in the serrated manner, an actuator 61 (refer to FIG. 30) configured to move the coupling 70 up and down, a rod 62 (refer to FIG. 30) and a lever 63 (refer to FIG. 30).

That is, the coupling 70 may be movable up and down while being coupled to the spin-dry shaft 170.

The clutch device 60 may be provided separately from the shaft assembly 160 and the bearing housing 80, and coupled to a lower surface of the tub 20. A description of a detail configuration of the clutch device 60 will be described later.

<Coupling Structure of the Main Member and the Cover Member of the Bowl Portion>

FIG. 4 is a view illustrating a coupling structure of a cylindrical portion and a bowl portion in accordance with a first embodiment. FIG. 5 is a cross-sectional view taken along a line I-I of FIG. 4. FIG. 6 is an enlarged view illustrating B of FIG. 5, particularly illustrating a relationship between a foreign material prevention protrusion and a coupling member. FIG. 7 is a cross-sectional view (including a pulsator) taken along a line II-II of FIG. 4

A coupling structure of the main member and the cover member of the bowl portion according to a first embodiment will be described with reference to FIGS. 4 to 7.

According to the first embodiment, an outer circumferential side of the main member 110 and an outer circumferential side of the cover member 130 are coupled to each other by curling of the cover member 130, and an inner circumferential side of the main member 110 and an inner circumferential side of the cover member 130 are coupled to each other by a coupling member and a locking structure.

The bowl portion 100 may be formed such that the cover member 130 formed of the metal material such as the stainless steel (SUS) is coupled to an upper surface of the main member 110 formed of the resin material. The cover member 130 may be closely coupled to the upper surface of the main member 110.

The flange 190 to which the spin-dry shaft 170 is coupled may be inserted into the main member 110.

The main member 110 may be formed such that the inner circumferential portion thereof is the lowest and the main member 110 protrudes upward as from the inner circumferential portion to the radially outer side.

The main member 110 may include a bottom portion 111 formed at the inner circumferential portion thereof, a flat portion 112 formed at a radially outer side of the bottom portion 111, a step portion 113 rapidly inclined in the flat portion 112, and an inclined portion 114 extended to be gently inclined at the step portion 113.

The bottom portion 111 may be provided with a water discharge passage 115 through which the washing water of the rotating tub 30 can flow.

The pulsator 40 may be accommodated in a space formed by the bottom portion 111, the flat portion 112, and the step portion 113 (refer to FIG. 7).

A foreign material prevention rib 124 may protrude from the flat portion 112 to form a foreign material prevention protrusion 101 to prevent foreign materials such as a coin and a button, from falling down in the pulsator 40. A plurality of prevention protrusions 101 may be provided at a certain interval along the circumferential direction.

The cover member 130 may be formed in a donut shape having a hollow 131 so as to cover the outer circumferential portion of the main member 110 except the inner circumferential portion.

The cover member 130 includes a first engaging portion configured to allow the cover member 130 to be coupled to the main member 110 and the main member 110 includes a second engaging portion coupled to the first engaging portion.

The first engaging portion may include an outer curling portion 132 formed by the outer circumferential portion of the cover member 130, which is bent toward the radially inward direction, and the second engaging portion may include an outer curling protrusion 116 protruded to be covered by the outer curling portion 132 so as to be coupled to the outer curling portion 132.

The outer curling protrusion 116 may be protruded radially outward of the main member 110 so as to be surrounded by the outer curling portion 132.

The outer curling protrusion 116 may be formed on the upper outer side of the main member 110.

The outer curling protrusion 116 may include an extension portion 117 extending radially outward from the inclined portion 114, an outer circumferential surface portion 118 extending downward from the extension portion 117 and forming an outer circumferential surface of the main member 110, and a curling support 119 extending radially inward from the outer circumferential surface portion 118.

A weight loss groove 121 and a support rib 120 configured to reinforce the strength may be formed in the inside of the outer curling protrusion 116.

A curling groove 122 in which a second bending portion 135 described later is bent may be formed below the outer curling protrusion 116.

The outer curling portion 132 may include a base portion 133 in contact with the extension portion 117, a first bending portion 134 bent in the base portion 133 to be in contact with the outer circumferential surface portion 118 and the second bending portion 135 bent in the first bending portion 134 to be in contact with the curling support 119.

After the entire of the cover member 130 comes into contact with the main member 110 from the upper side to the lower side, it may be possible to bend the second bending portion 135 to be in contact with the curling support 119 (refer to an arrow of FIG. 5).

The first engaging portion may include an inner through hole 136 formed in an inner circumferential portion of the cover member 130 so that the coupling member S1 penetrates from the upper side to the lower side, and the second engaging portion may include an inner fastening hole 123 formed at a position corresponding to the inner through hole 136 to allow the coupling member S1 to be coupled from the upper side to the lower side.

The inner fastening hole 123 may be formed in the flat portion 112 of the main member 110. In this embodiment, the coupling member S1 is a screw, but a pin, bolt, rivet, or the like may be used. The coupling member S1 may be disposed between a plurality of the foreign material prevention ribs 101 arranged at a constant interval along the circumferential direction (refer to FIG. 6). The coupling member S1 may be provided such that an upper end thereof is not higher than an upper end of the foreign material prevention ribs 101 (refer to FIG. 5).

The first engaging portion may include a locking hole 137 and the second engaging portion may include a locking hook 125 protruding to be locked when being inserted into the locking hole 137 (refer to FIG. 7).

The locking hook 125 may protrude radially inward from the stepped portion of the main member 110. The locking hook 125 may include a locking surface 126 locked by the locking hole 137 to prevent the cover member 130 from escaping to the upper side, and a guide surface 127 configured to guide the locking hook 125 to be inserted into the locking hole 137.

FIG. 8 is a cross-sectional view illustrating a coupling structure of a main member and a cover member of a bowl portion in accordance with a second embodiment of the present disclosure.

A coupling structure of the main member and the cover member of the bowl portion according to the second embodiment will be described with reference to FIG. 8. The same reference numerals are assigned to the same components as those of the first embodiment, and a description thereof will be omitted.

According to the second embodiment, an outer circumferential side and an inner circumferential side of a main member 210 of the bowl portion may be coupled to an outer circumferential side and an inner circumferential side of a cover member 230 of the bowl portion by a coupling member.

The bowl portion 200 may be formed such that the cover member 230 formed of the metal material such as the stainless steel (SUS) is coupled to an upper surface of the main member 210 formed of the resin material. The cover member 230 may be closely coupled to the upper surface of the main member 210.

The main member 210 may be formed such that the inner circumferential portion thereof is the lowest and the main member 210 protrudes upward as from the inner circumferential portion to the radially outer side.

The main member 210 may include a bottom portion 211 formed at the inner circumferential portion thereof, a flat portion 212 formed at a radially outer side of the bottom portion 211, a step portion 213 rapidly inclined in the flat portion 212, and an inclined portion 214 extended to be gently inclined at the step portion 213.

The cover member 230 may be formed in a donut shape to cover the outer circumferential portion of the main member 210 except the inner circumferential portion.

The cover member 230 includes a first engaging portion configured to allow the cover member 230 to be coupled to the main member 210 and the main member 210 includes a second engaging portion coupled to the first engaging portion.

The first engaging portion may include an outer through hole 238 formed in an outer circumferential portion of the cover member 230 so that a coupling member S2 penetrates from radially outward to radially inward, and the second engaging portion may include an outer fastening hole 228 formed at a position corresponding to the outer through hole 238 to allow the coupling member S2 to be coupled from radially outward to radially inward.

Meanwhile, the bowl portion 200 and the cylindrical portion 32 may be coupled to each other by the coupling member S2. For this, a cylindrical portion through hole 38 may be formed in the cylindrical portion 32 to allow the coupling member S2 to be passed through.

The first engaging portion may include an inner through hole 233 formed in an inner circumferential portion of the cover member 230 so that a coupling member S1 penetrates from the upper side to the lower side, and the second engaging portion may include an inner fastening hole 223 formed at a position corresponding to the inner through hole 233 to allow the coupling member S1 to be coupled from the upper side to the lower side.

The inner fastening hole 223 may be formed in the flat portion 212 of the main member 210. In this embodiment, a screw may be used as the coupling member S1, but a pin, bolt, rivet, or the like may be used.

FIG. 9 is a cross-sectional view illustrating a coupling structure of a main member and a cover member of a bowl portion in accordance with a third embodiment of the present disclosure.

A coupling structure of the main member and the cover member of the bowl portion according to the third embodiment will be described with reference to FIG. 9. The same reference numerals are assigned to the same components as those of the above mentioned embodiment, and a description thereof will be omitted.

According to the third embodiment, an outer circumferential side and an inner circumferential side of a main member 310 of the bowl portion may be coupled to an outer circumferential side and an inner circumferential side of a cover member 330 of the bowl portion by curling of the cover member 330.

The bowl portion 300 may be formed such that the cover member 330 formed of the metal material such as the stainless steel (SUS) is coupled to an upper surface of the main member 310 formed of the resin material. The cover member 330 may be closely coupled to the upper surface of the main member 310.

The main member 310 may be formed such that the inner circumferential portion thereof is the lowest and the main member 310 protrudes upward as from the inner circumferential portion to the radially outer side.

The main member 310 may include a bottom portion 311 formed at the inner circumferential portion thereof, a flat portion 312 formed at a radially outer side of the bottom portion 311, an inclined portion 314 extended to be gently inclined, and a reversely inclined portion 327 formed between the flat portion 312 and the inclined portion 314 so as to have a gradient opposite to the inclined portion 314.

The cover member 330 may be formed in a donut shape to cover the outer circumferential portion of the main member 310 except the inner circumferential portion.

The cover member 330 includes a first engaging portion configured to allow the cover member 330 to be coupled to the main member 310 and the main member 310 includes a second engaging portion coupled to the first engaging portion.

The first engaging portion may include an outer curling portion 332 formed by the outer circumferential portion of the cover member 330, which is bent toward the radially inward direction, and the second engaging portion may include an outer curling protrusion 316 protruded to be covered by the outer curling portion 332 so as to be coupled to the outer curling portion 332.

The outer curling protrusion 316 may be protruded radially outward of the main member 310 so as to be surrounded by the outer curling portion 332.

The outer curling protrusion 316 may be formed on the outer side of the upper end portion of the main member 310.

The outer curling protrusion 316 may include an extension portion 317 extending radially outward from the inclined portion 314, an outer circumferential surface portion 318 extending downward from the extension portion 317 and forming an outer circumferential surface of the main member 310, and a curling support 319 extending radially inward from the outer circumferential surface portion 318.

A weight loss groove 321 and a support rib 320 configured to reinforce the strength may be formed in the inside of the outer curling protrusion 316.

A curling groove 322 in which a second bending portion 335 described later is bent may be formed below the outer curling protrusion 316.

The outer curling portion 332 may include a base portion 333 in contact with the extension portion 317, a first bending portion 334 bent in the base portion 333 to be in contact with the outer circumferential surface portion 318 and the second bending portion 335 bent in the first bending portion 334 to be in contact with the curling support 319.

After the entire of the cover member 330 comes into contact with the main member 310 from the upper side to the lower side, it may be possible to bend the second bending portion 335 to be in contact with the curling support 319.

The first engaging portion may include an inner curling portion 336 formed by the inner circumferential portion of the cover member 330, which is bent toward the radially outward direction, and the second engaging portion may include an inner curling protrusion 325 protruded to be covered by the inner curling portion 336 so as to be coupled to the inner curling portion 336.

The inner curling protrusion 325 may include an inclined end portion 326 of the main member 310, and a reversely inclined portion 327.

The inner curling portion 336 may include a stem portion 337 in contact with the inclined end portion 326, and a bending portion 338 bent at the stem portion 337 to be in contact with the reversely inclined portion 327.

After the entire of the cover member 330 comes into contact with the main member 310 from the upper side to the lower side, it may be possible to bend the bending portion 338 to be in contact with the reversely inclined portion 327.

FIGS. 10 and 11 are views illustrating a coupling structure of a main member and a cover member of a bowl portion in accordance with a fourth embodiment of the present disclosure.

A coupling structure of the main member and the cover member of the bowl portion according to the fourth embodiment will be described with reference to FIGS. 10 and 11. The same reference numerals are assigned to the same components as those of the above mentioned embodiment, and a description thereof will be omitted.

According to the fourth embodiment, an outer circumferential side of a main member 410 of the bowl portion may be coupled to an outer circumferential side of a cover member 430 of the bowl portion by curling or by a coupling member, and an inner circumferential side of a main member 410 of the bowl portion may be coupled to an inner circumferential side of a cover member 430 of the bowl portion by a fitting structure.

The bowl portion 400 may be formed such that the cover member 430 formed of the metal material such as the stainless steel (SUS) is coupled to an upper surface of the main member 410 formed of the resin material. The cover member 430 may be closely coupled to the upper surface of the main member 410.

The main member 410 may be formed such that the inner circumferential portion thereof is the lowest and the main member 410 protrudes upward as from the inner circumferential portion to the radially outer side.

The main member 410 may include a bottom portion 411 formed at the inner circumferential portion thereof, a flat portion 412 formed at a radially outer side of the bottom portion 411, a step portion 413 rapidly inclined in the flat portion 412, and an inclined portion 414 extended to be gently inclined from the step portion 413.

The cover member 430 may be formed in a donut shape to cover the outer circumferential portion of the main member 410 except the inner circumferential portion.

The cover member 430 includes a first engaging portion configured to allow the cover member 430 to be coupled to the main member 410 and the main member 410 includes a second engaging portion coupled to the first engaging portion.

The first engaging portion may include an insertion portion 431 provided on the inner circumferential of the cover member 430, and the second engaging portion may include an insertion groove 425 provided to allow the insertion portion 431 to be inserted thereinto.

A partition wall 424 may protrude toward the upper side from the flat portion 412 of the main member 410, and the insertion groove 425 may be formed between the partition wall 424 and the step portion 413. The insertion portion 431 may be fitted-coupled to the insertion groove 425.

A direction fixing portion 421 configured to prevent the rotation of the cover member 430 may be provided in the insertion groove 425 of the main member 410. The direction fixing portion 421 may include a first direction fixing surface 422 configured to prevent the cover member 430 from rotating in a first direction and a second direction fixing surface 423 configured to prevent the cover member 430 from rotating in a second direction opposite to the first direction.

The cover member 430 may include a first direction locking surface 432 locked by the first direction fixing surface 422 and a second direction locking surface 433 locked by the second direction fixing surface 423.

FIG. 12 is a view illustrating a coupling structure of a main member and a cover member of a bowl portion in accordance with a fifth embodiment of the present disclosure.

A coupling structure of the main member and the cover member of the bowl portion according to the fifth embodiment will be described with reference to FIG. 12. The same reference numerals are assigned to the same components as those of the above mentioned embodiment, and a description thereof will be omitted.

According to the fifth embodiment, an outer circumferential side of a main member 510 of the bowl portion may be coupled to an outer circumferential side of a cover member 530 of the bowl portion by curling or by a coupling member, and an inner circumferential side of the main member 510 of the bowl portion may be coupled to an inner circumferential side of the cover member 530 of the bowl portion by the fitting structure. That is, the structure according to the fifth embodiment is similar with the structure according to the fourth embodiment, but the structural details of the fitting structure are different.

The bowl portion 500 may be formed such that the cover member 530 formed of the metal material such as the stainless steel (SUS) is coupled to an upper surface of the main member 510 formed of the resin material. The cover member 530 may be closely coupled to the upper surface of the main member 510.

The main member 510 may be formed such that the inner circumferential portion thereof is the lowest and the main member 510 protrudes upward as from the inner circumferential portion to the radially outer side.

The main member 510 may include a bottom portion 511 formed at the inner circumferential portion thereof, a flat portion 512 formed at a radially outer side of the bottom portion 511, a step portion 513 rapidly inclined in the flat portion 512, and an inclined portion 514 extended to be gently inclined from the step portion 513.

The cover member 530 may be formed in a donut shape to cover the outer circumferential portion of the main member 510 except the inner circumferential portion.

The cover member 530 includes a first engaging portion configured to allow the cover member 530 to be coupled to the main member 510 and the main member 510 includes a second engaging portion coupled to the first engaging portion.

The first engaging portion may include an insertion portion 531 provided on the inner circumferential portion of the cover member 530, and the second engaging portion may include an insertion groove 521 provided to allow the insertion portion 531 to be inserted thereinto.

The insertion portion 531 may be formed in a protrusion shape protruding from a corner of the inner circumferential portion of the cover member 530. The insertion groove 521 may be a groove or a through hole formed in the flat portion 512 of the main member 510.

FIG. 13 is a view illustrating a coupling structure of a main member and a cover member of a bowl portion in accordance with a sixth embodiment of the present disclosure.

A coupling structure of the main member and the cover member of the bowl portion according to the sixth embodiment will be described with reference to FIG. 13. The same reference numerals are assigned to the same components as those of the above mentioned embodiment, and a description thereof will be omitted.

According to the sixth embodiment, an outer circumferential side of a main member 610 of the bowl portion may be coupled to an outer circumferential side of a cover member 630 of the bowl portion by curling or by a coupling member, and an inner circumferential side of the main member 610 of the bowl portion may be coupled to an inner circumferential side of the cover member 630 of the bowl portion by the fitting structure. That is, the structure according to the sixth embodiment is similar with the structure according to the fourth embodiment, but the structural details of the fitting structure are different.

The bowl portion 600 may be formed such that the cover member 630 formed of the metal material such as the stainless steel (SUS) is coupled to an upper surface of the main member 610 formed of the resin material. The cover member 630 may be closely coupled to the upper surface of the main member 610.

The main member 610 may be formed such that the inner circumferential portion thereof is the lowest and the main member 610 protrudes upward as from the inner circumferential portion to the radially outer side.

The main member 610 may include a bottom portion 611 formed at the inner circumferential portion thereof, a flat portion 612 formed at a radially outer side of the bottom portion 611, a step portion 613 rapidly inclined in the flat portion 612, and an inclined portion 614 extended so as to be gently inclined from the step portion 613.

The cover member 630 may be formed in a donut shape to cover the outer circumferential portion of the main member 610 except the inner circumferential portion.

The cover member 630 includes a first engaging portion configured to allow the cover member 630 to be coupled to the main member 610 and the main member 610 includes a second engaging portion coupled to the first engaging portion.

The first engaging portion may include an insertion portion 631 and the second engaging portion may include an insertion groove 621 provided to allow the insertion portion 631 to be inserted thereinto.

The insertion portion 631 may be provided in a corner of the inner circumferential portion of the cover member 630.

In the flat portion 612 of the main member 610, an insertion rib 622 may protrude upward. The insertion groove 621 may be formed between the insertion rib 622 and the step portion 613 of the main member 610.

The insertion portion 631 and the insertion groove 621 may be formed continuously along a circumferential direction, respectively.

FIG. 14 is a view illustrating a coupling structure of a main member and a cover member of a bowl portion in accordance with a seventh embodiment of the present disclosure.

A coupling structure of the main member and the cover member of the bowl portion 700 according to the seventh embodiment will be described with reference to FIG. 14. The same reference numerals are assigned to the same components as those of the above mentioned embodiment, and a description thereof will be omitted.

According to the seventh embodiment, a main member 710 and a cover member 730 of the bowl portion 700 may be coupled by an insert injection.

That is, after the cover member 730 is inserted into a mold of the main member 710, melt fluid may be injected into the mold. Accordingly, the cover member 730 may be inserted into the inside of the main member 710 and thus the cover member 730 may be integrally formed with the main member 710.

FIG. 15 is a view illustrating a coupling structure of a main member and a cover member of a bowl portion in accordance with an eighth embodiment of the present disclosure.

A coupling structure of the main member and the cover member of the bowl portion 800 according to the eighth embodiment will be described with reference to FIG. 15. The same reference numerals are assigned to the same components as those of the above mentioned embodiment, and a description thereof will be omitted.

According to the eighth embodiment, a main member 810 and a cover member 830 of the bowl portion 800 may be coupled by an additional adhesive member 840.

The adhesive member 840 may be in the form of double-stick adhesive tape, or in the form of paint applied to the main member 810 or the cover member 830.

FIG. 16 is a view illustrating a coupling structure of a main member and a cover member of a bowl portion in accordance with a ninth embodiment of the present disclosure. FIGS. 17 and 18 are enlarged views of C portion of FIG. 16, particularly, a view illustrating a coupling structure of a heat-sealing protrusion and a heat-sealing hole.

A coupling structure of the main member and the cover member of the bowl portion according to the ninth embodiment will be described with reference to FIGS. 16 to 18. The same reference numerals are assigned to the same components as those of the above mentioned embodiment, and a description thereof will be omitted.

According to the ninth embodiment, an outer circumferential side and an inner circumferential side of a main member 910 of the bowl portion may be coupled to an outer circumferential side and an inner circumferential side of a cover member 930 of the bowl portion by a heat-sealing method, but is not limited thereto. Unlike the embodiment, any one of the outer circumferential side and the inner circumferential side is coupled by the heat-sealing method, and the other side may be coupled by using a variety of methods such as the curling, the coupling member, the locking structure, and the insertion structure.

The bowl portion 900 may be formed such that the cover member 930 formed of the metal material such as the stainless steel (SUS) is coupled to an upper surface of the main member 910 formed of the resin material. The cover member 930 may be closely coupled to the upper surface of the main member 910.

The main member 910 may be formed such that the inner circumferential portion thereof is the lowest and the main member 910 protrudes upward as from the inner circumferential portion to the radially outer side.

The main member 910 may include a bottom portion 911 formed at the inner circumferential portion thereof, a flat portion 912 formed at a radially outer side of the bottom portion 911, a step portion 913 rapidly inclined in the flat portion 912, an inclined portion 914 extended to be gently inclined from the step portion 913, and an upper portion 915 formed to be flat at a radially outer side of the inclined portion 914.

The cover member 930 may be formed in a donut shape to cover the outer circumferential portion of the main member 910 except the inner circumferential portion.

The cover member 930 includes a first engaging portion configured to allow the cover member 930 to be coupled to the main member 910 and the main member 910 includes a second engaging portion coupled to the first engaging portion.

The first engaging portion may include a heat-sealing hole 931 and the second engaging portion may include a heat-sealing protrusion 920 configured to pass through the heat-sealing hole 931 and when the heat is applied, configured to be blunt to be locked by the heat-sealing hole 931.

The heat-sealing protrusion 920 may protrude from the flat portion 912 and the upper portion 915 of the main member 910 to the upper side. The heat-sealing hole 931 may be formed in a position corresponding to the heat-sealing protrusion 920 to allow the heat-sealing protrusion 920 to be passed therethrough.

In the upper portion of the cover member 930, a heat-sealing member 940 may be provided. The heat-sealing member 940 may be provided with a through hole 941 through which the heat-sealing protrusion 920 is passed. Therefore, the heat-sealing protrusion 920 may continuously pass through the heat-sealing hole 931 of the cover member 930 and the through hole 941 of the heat-sealing member 940.

An upper end 921 of the heat-sealing protrusion 920 may protrude to the upper side of the heat-sealing member 940 by passing through the through hole 941, and when the heat is applied, the upper end 921 of the heat-sealing protrusion 920 may be melt and blunt so as to have a diameter larger than the through hole 941. Accordingly, the upper end 921 may be adhered to the heat-sealing member 940.

The heat-sealing member 940 may be formed of a material the same as the heat-sealing protrusion 920 of the main member 910 so that the heat-sealing member 940 is easily adhered to the heat-sealing protrusion 920.

<Structure in which the flange is inserted in the main member of the bowl portion>

FIG. 19 is a partial cross-sectional view illustrating a structure in which the flange is inserted in the main member of the bowl portion in accordance with an embodiment of the present disclosure. FIG. 20 is a perspective view illustrating the flange in accordance with an embodiment of the present disclosure. FIG. 21 is a bottom perspective view illustrating the flange in accordance with one embodiment of the present disclosure. FIG. 22 is a bottom view illustrating the flange in accordance with an embodiment of the present disclosure.

The structure in which the flange is inserted into the main member of the bowl portion according to an embodiment of the present disclosure will be described with reference to FIGS. 19 to 22. A description the same as the above mentioned description will be omitted.

The flange 190 is coupled to the bowl portion 100 of the rotating tub 30. The spin-dry shaft 170 of the shaft assembly 160 may be connected to an inner circumferential surface of the flange 190. Therefore, the flange 190 may receive the rotational force of the spin-dry shaft 170 to transmit the rotation force to the bowl portion 100.

The flange 190 may be inserted into the inside of the main member 110 of the bowl portion 100 so that the flange 190 is integrally formed with the bowl portion 100. By using the structure, it may be possible to reinforce the strength of the bowl portion 100 and to reduce a vertical length of the shaft system.

The flange 190 may include a hub portion 191 having a hollow 192 into which the spin-dry shaft 170 is inserted, and a plurality of blades 194 extending in the radial direction from the hub portion 191.

A serrated portion 193 may be formed in an inner circumferential surface of the hub portion 191, and the serrated portion 193 of the hub portion 191 may be coupled to the spin-dry shaft upper serrated portion 173 (refer to FIG. 3) of the spin-dry shaft 170 in a serrated manner. Therefore, the spin-dry shaft 170 may be movable in the axial direction to transmit the rotational force to the flange 190.

The blade 194 may be extended in the radial direction from the hub portion 191 to uniformly transmit the rotational force to the bowl portion 100 and to increase the torque to the bowl portion 100.

The blade 194 includes a blade body portion 195, and a blade flange portion 196 formed in an end portion of the blade body portion 195.

The blade flange portion 196 may be formed in an end portion in the axial direction in the housing blade portion 195.

The blade flange portion 196 may be provided to have a width greater than a width of the blade body portion 195. That is, when the blade body portion 195 has a first width W1 (refer to FIG. 22), the blade flange portion 196 may have a second width W2 (refer to FIG. 22) that is greater than the first width W1.

By using the structure, the flange 190 may be stably inserted into the inside of the main member 110.

The flange 190 may include a ring portion 197 configured to connect an end portion in the radial direction of the plurality of blades 194. The ring portion 197 may allow the strength of the plurality of blades 194 to be reinforced and to allow the flange 190 to be stably inserted into the inside of the main member 110.

By using the above mentioned structure, in comparison with the flange 190 in the conventional manner, the flange 190 may have a smaller size while having a higher strength and the flange 190 may be stably inserted into the inside of the main member 110. In addition, since the flange 190 is inserted into the inside of the main member 110, it may be possible to reinforce the strength of the bowl portion 100 and to reduce the vertical length of the shaft system.

FIG. 23 is a view illustrating a flange in accordance with another embodiment of the present disclosure.

The flange according to another embodiment will be described with reference to FIG. 23. A description the same as the above mentioned description will be omitted.

A flange 290 is coupled to a bowl portion 100 of a rotating tub 30. A spin-dry shaft 270 of a shaft assembly 160 may be connected to an inner circumferential surface of the flange 290. Therefore, the flange 290 may receive the rotational force of the spin-dry shaft 270 to transmit the rotation force to the bowl portion 100.

The flange 290 may be inserted into the inside of the main member 110 of the bowl portion 100 so that the flange 290 is integrally formed with the main member 110. By using the structure, it may be possible to reinforce the strength of the bowl portion 100 and to reduce a vertical length of the shaft system.

The flange 290 may include a bush portion 291 formed in the cylindrical shape having a hollow 292. A serrated portion 293 may be formed in an inner circumferential surface of the bush portion 291, and the serrated portion 293 of the bush portion 291 may be coupled to the spin-dry shaft upper serrated portion 173 (refer to FIG. 3) of the spin-dry shaft 170 in a serrated manner. Therefore, the spin-dry shaft 170 may be movable in the axial direction so as to transmit the rotational force to the flange 290.

A separation prevention portion 294 may be formed in an outer circumferential surface of the bush portion 291 so as to prevent the flange 290 from escaping when the injection of the main member 110. The separation prevention portion 294 may be extended in the horizontal direction in the outer circumferential surface of the bush portion 291. However, the shape of the separation prevention portion 294 is not limited thereto.

<Structure of Reinforcing Rib>

FIGS. 24 and 25 are views illustrating a reinforcing rib of the rotating tub in accordance with an embodiment of the present disclosure.

The reinforcing rib will be described in accordance with an embodiment with reference to FIGS. 25 and 26.

In the bowl portion 100 of the rotating tub 30, a reinforcing rib 103 may protrude to reinforce the strength. Particularly, the reinforcing rib 103 may protrude from a bottom surface 102 of the main member 110 of the bowl portion 100.

The reinforcing rib 103 includes a rib hub portion 108 formed in the circular shape in the center portion to have a shaft accommodation portion 109.

The reinforcing rib 103 includes a plurality of radial ribs 104 extended from the rib hub portion 108 in the radial direction, and a plurality of circular ribs 105 extended from the rib hub portion 108 in the circumferential direction. The plurality of circular ribs 105 may form a concentric relationship with each other.

The reinforcing rib 103 may include a diagonal rib 107 connecting intersection points formed by the radial ribs 104 and the circular ribs 105.

Referring to FIG. 25, particularly, the diagonal rib 107 may connect intersection points which are not adjacent to each other among a plurality of intersection points 106*a*, 106*b*, 106*c*, and 106*d* in which the radial ribs 104*a* and 104*b*, which are adjacent to each other, and the circular ribs 105*a* and 105*b*, which are adjacent to each other, are intersected to each other.

According to an embodiment, the diagonal rib 107 may be configured to connect an intersection point 106*a* to an intersection point 106*c*. Alternatively, the diagonal rib 107 may be configured to connect an intersection point 106*b* to an intersection point 106*d*.

The diagonal rib 107 may be provided in a straight line to connect the intersection points with the shortest distance or alternatively, in a curved line.

At least two diagonal ribs 107 may be provided to allow the diagonal ribs 107 to be symmetrical with respect to the shaft accommodation portion 109, i.e., a center the rotation of the rotating tub 30.

Unlike this embodiment, the diagonal rib may be configured to connect intersection points which are not adjacent to each other among a plurality of intersection points, in which the radial ribs, which are adjacent to each other, and the circular ribs, which are not adjacent to each other, are intersected to each other.

Alternatively, the diagonal rib may be configured to connect intersection points which are not adjacent to each other among a plurality of intersection points, in which the radial ribs, which are not adjacent to each other, and the circular ribs, which are adjacent to each other, are intersected to each other.

Alternatively, the diagonal rib may be configured to connect intersection points which are not adjacent to each other among a plurality of intersection points, in which the radial ribs, which are not adjacent to each other, and the circular ribs, which are not adjacent to each other, are intersected to each other.

The diagonal rib 107 may prevent the risk of the displacement in the bowl portion 100, which is caused by the load on the bowl portion 100 by the centrifugal force upon rotation of the rotary tub 30, by using a less amount of the resin.

FIG. 26 is a view illustrating a reinforcing rib of the tub in accordance with an embodiment of the present disclosure.

As illustrated in FIG. 26, the diagonal rib may be applied to the tub 20 as well as the rotating tub.

A reinforcing rib 23 configured to reinforce the strength may protrude on a bottom surface 22 of the tub 20.

The reinforcing rib 23 includes a plurality of radial ribs 24 extended in the radial direction, and a plurality of circular ribs 25 extended in the circumferential direction. The plurality of circular ribs 25 may form a concentric relationship with each other.

The reinforcing rib 23 may include a diagonal rib 27 connecting intersection points forming by the radial ribs 24 and the circular ribs 25.

The diagonal rib 27 may connect intersection points which are not adjacent to each other among a plurality of intersection points, in which the radial ribs, which are adjacent to each other, and the circular ribs, which are adjacent to each other, are intersected to each other.

The diagonal rib 27 may be provided in a straight line to connect the intersection points with the shortest distance or alternatively, in a curved line.

At least two diagonal ribs 27 may be provided to allow the diagonal rib 27 to be symmetrical with respect to a center of the tub 20.

Unlike this embodiment, the diagonal rib may be configured to connect intersection points which are not adjacent to each other among a plurality of intersection points, in which the radial ribs, which are adjacent to each other, and the circular ribs, which are not adjacent to each other, are intersected to each other.

Alternatively, the diagonal rib may be configured to connect intersection points which are not adjacent to each other among a plurality of intersection points, in which the radial ribs, which are not adjacent to each other, and the circular ribs, which are adjacent to each other, are intersected to each other.

Alternatively, the diagonal rib may be configured to connect intersection points which are not adjacent to each other among a plurality of intersection points, in which the radial ribs, which are not adjacent to each other, and the circular ribs, which not are adjacent to each other, are intersected to each other.

<Shaft System>

FIG. 27 is a partial cross-sectional view illustrating a structure in which the bearing housing is inserted into the inside of the tub in accordance with an embodiment of the present disclosure. FIG. 28 is a view illustrating the bearing housing in accordance with an embodiment of the present disclosure. FIG. 29 is a view illustrating a method of assembling the shaft system in accordance with an embodiment of the present disclosure. FIG. 30 is a view illustrating the clutch device in accordance with an embodiment of the present disclosure.

The shaft system of the washing machine and the assemble structure of the shaft system according to an embodiment will be described with reference to FIGS. 27 to 30.

The shaft system includes a shaft assembly 160, a clutch device 60, and a bearing housing 80. The shaft assembly 160 is provided with a hollow spin-dry shaft 170 configured to transmit the driving force to the rotating tub 30, and a washing shaft 180 provided in the inside of the spin-dry shaft 170 to transmit the driving force to the pulsator 40. The clutch device 60 is configured to connect or disconnect the motor to the spin-dry shaft 170. The bearing housing 80 is configured to rotatably support the shaft assembly 160 to reinforce the strength of the tub 20.

The shaft assembly 160, the clutch device 60 and the bearing housing 80 may be provided separately.

Particularly, the bearing housing 80 may be inserted into the inside of the tub 20 so that the bearing housing 80 is integrally formed with the tub 20. The shaft assembly 160 may be mounted from top to bottom along the inner circumferential surface of the bearing housing 80. The clutch device 60 may be coupled to the bottom surface of the tub 20 via a coupling member such as a screw.

As mentioned above, since the shaft assembly 160, the clutch device 60, and the bearing housing 80 are provided separately, it is possible to repair, replace and perform after service (A/S) by parts and thus the flexibility and the expandability may be achieved. In addition, when repairing and replacing the shaft assembly 160, it may be possible to repair by parts and thus it may be possible to reduce the cost.

The bearing housing 80 may be formed of an aluminum alloy material. The bearing housing 80 may include a housing hub portion 81 in which a bearing mounting portion 83 and 86, to which the bearing 177 and 178 is mounted, is formed, in an inner circumferential surface, and a plurality of housing blades 90 extended in the radially outer side from the housing hub portion 81.

The housing blade 90 may include a housing blade body 91 extended to have a first width, and a housing blade flange 92 formed in one end portion of the housing blade body 91 to be extended to have a second width greater than the first width.

By using the above mentioned structure, the bearing housing 80 may be stably inserted into the inside of the tub 20 and thus the strength of the tub 20 may be sufficiently reinforced.

As illustrated in FIG. 29, the spin-dry shaft bearing 177 and 178 configured to rotatably support the shaft assembly 160 may be mounted to the inner circumferential surface of the bearing housing 80. The spin-dry shaft bearing 177 and 178 may be press-fitted to the inner circumferential surface of the bearing housing 80.

The spin-dry shaft bearing 177 and 178 includes an upper spin-dry shaft bearing 177 configured to support an upper portion of an outer circumferential surface of the spin-dry shaft 170 and a lower spin-dry shaft bearing 178 configured to support a lower portion of the outer circumferential surface of the spin-dry shaft 170. The spin-dry shaft bearing 177 and 178 includes a ball bearing.

The bearing housing 80 may include an upper bearing mounting portion 83 to which the upper spin-dry shaft bearing 177 is mounted, and a lower bearing mounting portion 86 to which the lower spin-dry shaft bearing 178 is mounted.

The upper spin-dry shaft bearing 177 may be mounted to the upper bearing mounting portion 83 from the upper side to the lower side, and the lower spin-dry shaft bearing 178 may be mounted to the lower bearing mounting portion 86 from the lower side to the upper side.

The upper bearing mounting portion 83 may include a horizontal support surface 84 configured to support the bottom surface of the upper spin-dry shaft bearing 177, and a vertical support surface 85 configured to support the outer circumferential surface of the upper spin-dry shaft bearing 177.

The lower bearing mounting portion 86 may include a horizontal support surface 87 configured to support the upper surface of the lower spin-dry shaft bearing 178, and a vertical support surface 88 configured to support the outer circumferential surface of the lower spin-dry shaft bearing 178.

As mentioned above, after the spin-dry shaft bearing 177 and 178 is press-fitted to the inner circumferential surface of the bearing housing 80, the shaft assembly 160 including the washing shaft 180 and the spin-dry shaft 170 may be inserted into the spin-dry shaft bearing 177 and 178 from the upper side to the lower side.

The shaft assembly 160 may be coupled to the flange 190 before being inserted into the bearing 177 and 178, and thus the shaft assembly 160 may be inserted into the bearing 177 and 178 while being coupled to the flange 190.

The shaft assembly 160 may be loosely fitted to the bearing 177 and 178 so as to be inserted into the bearing 177 and 178. Therefore, the shaft assembly 160 may be easily separated from the bearing 177 and 178 after being inserted into the bearing 177 and 178.

In order to prevent the shaft assembly 160 from sliding downward from the bearing 177 and 178, a bearing support surface 179*a* and 179*b* supported by the bearing 177 and 178 may be formed in the spin-dry shaft 170.

In addition, in order to prevent the shaft assembly 160 from sliding upward from the bearing 177 and 178, a fixation nut 164 may be coupled to the lower portion of the shaft assembly 160. To this end, a fixing nut coupling portion 176 may be formed in the lower outer circumferential surface of the spin-dry shaft 170.

The lower fixation nut 164 coupled to the fixing nut coupling portion 176 may be supported by the lower spin-dry shaft bearing 178.

As mentioned above, finally, the lower fixation nut 164 is coupled to the lower portion of the shaft assembly 160 and thus the assembly of the shaft assembly 160 may be completed. When a user needs to disassemble the shaft assembly 160, a user may release the lower fixation nut 164 and then lift the shaft assembly 160 upward so that the shaft assembly 160 is separated.

The clutch device 60 may be configured with the coupling 70, the actuator 61, the rod 62 and a lever 63 and a rotation preventing member 67.

In a state in which the coupling 70 is coupled to the spin-dry shaft lower serrated portion 174 in a serrated manner, the coupling 70 may move up and down to be connected or disconnected to the rotor 52 of the motor.

The coupling 70 may include a serrated portion 71 coupled to the spin-dry shaft lower serrated portion 174 in the serrated manner, a lower toothed portion 73 engaged with a driving toothed portion 56 of the rotor 52, an upper toothed portion 72 engaged with a rotation prevention tooth 69 of the rotation preventing member 67, an upper flange portion 74 configured to be pressed upward by the lever 63, a lower flange portion 75 configured to be pressed downward by the lever 63, and a mounting groove 76 formed between the upper flange portion 74 and the lower flange portion 75 to allow an output terminal 65 of the lever 63 to be inserted thereinto.

The actuator 61 may allow the rod 62 to perform the linear movement by using a variety of energy sources such as electricity and hydraulic. The actuator 61 may be fixedly coupled to the bottom surface of the tub 20.

The rod 62 may perform the linear movement by the actuator 61. One end of the rod 62 is connected to the actuator 61 and the other end of the rod 62 is connected to the lever 63, so that the linear movement of the rod 62 may be converted to the rotational movement of the lever 63.

The lever 63 may be arranged to rotate about a rotational axis 66. A rotation pin 68 of the rotation preventing member 67 may be inserted into the rotational axis 66. An input terminal 64 of the lever 63 may be disposed in a position opposite to the output terminal 65 with respect to the rotational axis 66. The input terminal 64 of the lever 63 may be connected to the other side of the rod 62, and the output terminal 65 of the lever 63 may be inserted into the mounting groove 76 of the coupling 70. A plurality of output terminals 65 may be provided in the left and right side of the coupling 70 to easily lift the coupling 70.

The rotation preventing member 67 may be fixed to the bottom surface of the tub 20 to prevent the coupling 70 from rotating when the coupling 70 is raised. To this end, the rotation preventing member 67 may include the rotation prevention tooth 69 engaged with the upper toothed portion 72 of the coupling 70 when the coupling 70 is raised.

A brief description of the operation of the clutch device 60 having such a configuration will be described.

As mentioned above, the washing shaft lower serrated portion 182 of the washing shaft 180 is always press-fitted to a hollow 54 of the hub portion 53 of the rotor 52 or is coupled to a serration 55 of the hollow 54 in a serrated manner. Therefore, the washing shaft 180 may be rotated with the rotor 52 regardless of the clutch device 60.

In addition, the spin-dry shaft 170 is maintained to be coupled to the coupling 70 in a serrated manner. Therefore, the spin-dry shaft 170 is rotated with the coupling 70. However, the coupling 70 is configured such that the coupling 70 is coupled to the rotor 52 when the coupling 70 is lowered and the coupling 70 is separated from the rotor 52 when the coupling 70 is raised.

When the actuator 61 pulls the rod 62 in a direction D1, the output terminal 65 of the lever 63 may be rotated in a direction D3 and lift the coupling 70. Accordingly, the coupling 70 may be separated from the rotor 52 and thus although the rotor 52 is rotated, the coupling 70 and the spin-dry shaft 170 may be not rotated while the washing shaft 180 is rotated.

When the actuator 61 pushes the rod 62 in a direction D2, the output terminal 65 of the lever 63 may be rotated in a direction D4 and lower the coupling 70. Accordingly, the coupling 70 may be connected to the rotor 52 and thus when the rotor 52 is rotated, the washing shaft 180, the coupling 70 and the spin-dry shaft 170 may be rotated together with each other.

FIG. 31 is a view illustrating a shaft system according to another embodiment of the present disclosure.

The shaft system will be described according to another embodiment with reference to FIG. 31. The same reference numerals are assigned to the same components as those of the above mentioned embodiment, and a description thereof will be omitted.

A shaft assembly 260 is provided with a hollow spin-dry shaft 270 configured to transmit the driving force to the rotating tub 30, a washing shaft 180 provided in the inside of the spin-dry shaft 270 to transmit the driving force to the pulsator 40 and a bush axis 279 configured to surround an outer circumferential surface of the spin-dry shaft 270 to prevent the moisture from introducing into the spin-dry shaft 270.

That is, unlike the above-described embodiment, the shaft assembly 260 further includes a bush axis 279 coupled to the outer circumferential surface of the spin-dry shaft 270.

The spin-dry shaft 270 may be press-fitted and fixed to the hollow of the bush axis 279. The bush axis 279 may be formed of the stainless steel (SUS) material having good corrosion resistance. In addition, by the bush axis 279, the spin-dry shaft 270 may be prevented from the water contact, and thus the spin-dry shaft 270 may be formed of a general steel material, which is relatively inexpensive, instead of the stainless steel. In one example, the spin-dry shaft 270 may be formed of a material such as SM45C.

The bush axis 279 may be provided with a bearing support surface 279*a* supported by the bearing 177 so that the shaft assembly 260 is prevented from sliding downward when the shaft assembly 260 is inserted into the bearing 177 and 178 from the upper side to the lower side.

While the present disclosure has been particularly described with reference to exemplary embodiments, it should be understood by those of skilled in the art that various changes in form and details may be made without departing from the spirit and scope of the present disclosure.

The invention claimed is:

1. A washing machine comprising:

a body;

a rotating tub rotatably installed inside the body and provided with a cylindrical portion formed in a cylindrical shape and a bowl portion coupled to a lower portion of the cylindrical portion;

a flange coupled to the bowl portion of the rotating tub; and a spin-dry shaft connected to the flange to supply a rotational force to the rotating tub, wherein the bowl portion comprises a main member formed of a resin material and a cover member coupled to an upper surface of the main member and formed of a metal material, the cover member comprises a first engaging portion coupled to the main member, the main member comprises a second engaging portion coupled to the first engaging portion, and the main member further comprises a bottom portion, the flange comprises a hub portion having a hollow into which the spin-dry shaft is inserted and a plurality of blades extending in a radial direction from the hub portion to uniformly transmit the rotational force to the bowl portion of the rotating tub and to increase a torque to the bowl portion of the rotating tub, the plurality of blades of the flange are inserted into an inside portion of the main member of the bowl portion, the plurality of blades are covered by the bottom portion of the main member, and each of the plurality of blades comprises a blade body portion and a blade flange portion formed in an upper end portion of the blade body portion adjacent to the upper surface of the main member, the blade flange portion extending perpendicular to the blade body portion from opposite sides of the blade body portion such that the blade body portion substantially bisects a width of the blade flange portion and the width of the blade flange portion is greater than a width of the blade body portion.

2. The washing machine of claim 1, wherein:

the first engaging portion comprises an outer curling portion formed such that an outer circumferential portion of the cover member is bent in a radially inward direction, and the second engaging portion comprises an outer curling protrusion protruded to be covered by the outer curling portion so as to be coupled to the outer curling portion.

3. The washing machine of claim 1, wherein:

the first engaging portion comprises an inner curling portion formed such that an inner circumferential portion of the cover member is bent in a radially outward direction, and the second engaging portion comprises an inner curling protrusion protruded to be covered by the inner curling portion so as to be coupled to the inner curling portion.

4. The washing machine of claim 3, wherein the inner curling protrusion comprises a reversely inclined portion formed to be inclined downward in the radially outward direction.

5. The washing machine of claim 1, wherein:

the first engaging portion comprises an outer through hole formed in an outer circumferential portion of the cover member so that a coupling member penetrates from radially outward to radially inward, and the second engaging portion comprises an outer fastening hole to which the coupling member is coupled.

6. The washing machine of claim 1, wherein:

the first engaging portion comprises an inner through hole formed in an inner circumferential portion of the cover member so that a coupling member penetrates from an upper side to a lower side, and the second engaging portion comprises an inner fastening hole to which the coupling member is coupled.

7. The washing machine of claim 6, wherein:

the bowl portion comprises a plurality of foreign material prevention protrusions provided at a constant interval along a circumferential direction to prevent foreign materials from falling, and the coupling member is arranged among the foreign material prevention protrusions.

8. The washing machine of claim 1, wherein:

the first engaging portion comprises a locking hole, and the second engaging portion comprises a locking hook configured to protrude to be locked by being inserted into the locking hole.

9. The washing machine of claim 1, wherein the first engaging portion comprises an insertion portion and the second engaging portion comprises an insertion groove into which the insertion portion is inserted.

10. The washing machine of claim 1, wherein the first engaging portion comprises a heat sealing hole and the second engaging portion comprises a heat sealing protrusion configured to pass through the heat sealing hole and when heat is applied, configured to be deformed to be locked by the heat sealing hole.

11. The washing machine of claim 1, wherein the cover member is formed in a donut shape.

12. The washing machine of claim 1, wherein the first engaging portion is provided in an inner circumferential portion of the cover member and an outer circumferential portion of the cover member.

* * * * *